US010663239B2

(12) United States Patent
Timmons

(10) Patent No.: US 10,663,239 B2
(45) Date of Patent: May 26, 2020

(54) FIREARM TAKEDOWN PIN AND UPPER RECEIVER SYSTEM

(71) Applicant: David Rian Timmons, Ketchum, ID (US)

(72) Inventor: David Rian Timmons, Ketchum, ID (US)

( * ) Notice: Subject to any disclaimer, the term of this patent is extended or adjusted under 35 U.S.C. 154(b) by 0 days.

(21) Appl. No.: 15/963,800

(22) Filed: Apr. 26, 2018

(65) Prior Publication Data

US 2018/0313618 A1 Nov. 1, 2018

Related U.S. Application Data

(60) Provisional application No. 62/490,599, filed on Apr. 27, 2017.

(51) Int. Cl.

| | |
|---|---|
| ***F41A 3/66*** | (2006.01) |
| ***F41A 11/00*** | (2006.01) |
| ***F41A 3/64*** | (2006.01) |
| ***F41A 11/02*** | (2006.01) |
| ***F41A 17/38*** | (2006.01) |

(52) U.S. Cl.
CPC *F41A 3/66* (2013.01); *F41A 3/64* (2013.01); *F41A 11/00* (2013.01); *F41A 11/02* (2013.01); *F41A 17/38* (2013.01)

(58) Field of Classification Search
CPC .. F41A 3/66; F41A 11/00; F41A 11/02; F41A 11/04; F41A 99/00; F41C 7/11; F16B 15/02; F16B 17/00; F16B 19/00; F16B 19/02
USPC ..... 42/8, 40, 75.01, 75.03, 75.04; 411/356
See application file for complete search history.

(56) References Cited

U.S. PATENT DOCUMENTS

| | | | |
|---|---|---|---|
| 923,767 | A | 6/1909 | Buckius |
| 2,858,725 | A | 11/1958 | Thompson |
| 3,199,240 | A | 8/1965 | Largen |
| 3,236,155 | A | 2/1966 | Sturtevant |
| 4,406,194 | A | 9/1983 | Gersch |
| 4,521,985 | A | 6/1985 | Smith et al. |
| 5,155,284 | A | 10/1992 | Flashkes |

(Continued)

OTHER PUBLICATIONS

Screenshots of YouTube video, DIY AR-15 Build—Pivot Pin Installation, Jun. 8, 2011, 2 pages.

(Continued)

*Primary Examiner* — Bret Hayes
(74) *Attorney, Agent, or Firm* — Pedersen & Company, PLLC; Ken J. Pedersen; Barbara S. Pedersen

(57) ABSTRACT

A takedown pin system may be used for the processes of securing, semi-securing, and/or un-securing the rear connection points of firearm lower and upper receivers, for example, of an AR-15, with an option to maintain axial engagement of the pin to the receivers throughout two or more of the processes. An enhanced pin detent track allows pin rotation when axially-engaged in the receivers. A narrow pin body portion, for example, a recessed side surface portion or a narrow flange, cooperates with the pin hole and/or a slot in an upper receiver rear knuckle. Rotating the pin may locate the recess or flange to make room between the pin and the inner surface(s) of the upper receiver pin hole so the upper receiver can pivot slightly open from the lower receiver. A slot at the bottom of the rear knuckle hole may receive a flange of the takedown pin.

14 Claims, 28 Drawing Sheets

(56) References Cited

U.S. PATENT DOCUMENTS

| | | | | |
|---|---|---|---|---|
| 7,147,420 | B2 | 12/2006 | Baus et al. | |
| 7,937,876 | B1 | 5/2011 | Graham | |
| 8,474,169 | B2 | 7/2013 | Cottle et al. | |
| 8,826,798 | B2 | 9/2014 | Hochstrate et al. | |
| 9,151,555 | B1 * | 10/2015 | Huang | F16B 15/02 |
| 9,243,857 | B2 | 1/2016 | Mills et al. | |
| 9,389,031 | B2 | 7/2016 | Gardner | |
| D762,804 | S | 8/2016 | Gardner | |
| 9,441,897 | B2 | 9/2016 | Mather et al. | |
| 9,618,289 | B1 | 4/2017 | Geissele | |
| 9,772,156 | B1 | 9/2017 | Viviano et al. | |
| 9,784,518 | B2 | 10/2017 | Geissle | |
| 9,791,233 | B2 | 10/2017 | Geissele | |
| 10,066,888 | B2 | 9/2018 | Chang et al. | |
| 10,101,107 | B1 * | 10/2018 | Huang | F41A 3/66 |
| 2007/0180984 | A1 | 8/2007 | Huther | |
| 2013/0055610 | A1 | 3/2013 | Watkins | |
| 2013/0111794 | A1 | 5/2013 | Dionne et al. | |
| 2013/0276343 | A1 * | 10/2013 | Peters | F41C 33/006 42/90 |
| 2014/0317982 | A1 * | 10/2014 | Gentilini | F41A 3/12 42/16 |
| 2015/0308768 | A1 | 10/2015 | Mills et al. | |
| 2016/0377365 | A1 * | 12/2016 | Lee | F41A 21/00 89/139 |
| 2017/0016690 | A1 | 1/2017 | Timmons | |
| 2017/0051546 | A1 | 2/2017 | Seekins | |
| 2017/0184365 | A1 * | 6/2017 | Zajk | F41A 17/56 |
| 2017/0299292 | A1 * | 10/2017 | Daley, Jr. | F41A 11/00 |
| 2018/0066908 | A1 * | 3/2018 | Klein | F41A 11/00 |
| 2018/0187989 | A1 * | 7/2018 | Jen | F41A 3/66 |
| 2019/0049202 | A1 | 2/2019 | Kasanjian-King | |

OTHER PUBLICATIONS

Sequence of screenshots of YouTube video, AR-15 Pivot Pin Install—The Easy Way!, May 7, 2012, 3 pages.

Screenshot of YouTube video, Quick & Simple AR-15 Lower Receiver Front Pivot Takedown Pin Install and Remove, Dec. 30, 2014.

Webpages, dated Oct. 2017, showing BattleArms TM Quick Release Rear Takedown Pin (QRRTP TM), a version of which pin was shown/demonstrated at the NSSF SHOT SHOW TM in Las Vegas, Jan. 2017.

Screenshots of Juggernaut Tactical, YouTube™ video, https://www.youtube.com/watch?v=5SQOKzo9tl, Published Feb. 5, 2018.

* cited by examiner

FIREARM TAKEDOWN PIN AND UPPER RECEIVER SYSTEM

This application claims benefit of Provisional Application Ser. No. 62/490,599, filed Apr. 27, 2017, the entire disclosure of which is incorporated herein by this reference.

FIELD OF THE INVENTION

The invention relates to a firearm takedown pin and receiver system, for example, for securing, semi-securing, or un-securing the rear connection points of the lower and upper receivers of a firearm. A lower and upper receiver configuration comprising a takedown pin is a popular firearm platform utilized in a wide variety of firearms and is commonly known to be used for, but not limited to, AR15-style firearms.

BACKGROUND AND RELATED ART

Assuming a firearm, that is configured to use a lower and upper receiver configuration, is in sound working condition, it is common knowledge for those skilled in the art that the rear connection points of the lower receiver (the "rear coupler" hereafter) and of the upper receiver (the "rear knuckle" hereafter) will cooperate with each other and may be axially-engaged by a takedown pin to secure the rear connection points of the receivers. By "axial-engaged" is meant that the pin is inserted axially through axial pinhole(s) in each of the rear coupler and the rear knuckle. Furthermore, when the lower and upper receivers' rear connection points are securely axially-engaged and coupled together, the breach of the firearm is also known to be in a closed and operable position because the trigger hammer and the firing pin are in alignment. In this closed and operable position, the firearm can be properly discharged, when the trigger is depressed to cause the trigger hammer to strike the firing pin, which then strikes the primer of the round to discharge the round from the firearm.

Conversely, when the takedown pin is installed to the lower receiver, but axially-disengaged from the upper receiver, the upper and lower receivers are no longer securely connected at their rear connection points, and, thus, the receivers are allowed to separate at their rear connection points by pivoting on their forward pivot pin hinge. "Axially-disengaged" means axially inserted only to an extent that the pin extends into one (the proximal) sidewall of the lower receiver, and so into only one of the rear coupler pin holes, and not through the rear knuckle of the upper receiver. Thus, when the receivers are separated at their rear connection points enough to misalign the trigger hammer and the firing pin, they can no longer interact together and the firearm is considered to be in an inoperable mode. Furthermore, when the receivers are allowed to substantially pivot open and separate at their rear connection points, the internal bodies of the receivers and the components assembled within the receivers are accessible for cleaning, maintenance, and/or replacement. Thus, the takedown pin is an integral part of the overall configuration, safety, maintenance, and operation of a firearm using this type of lower and upper receiver configuration.

The takedown pin is conventionally a component of a "takedown pin assembly" that comprises the takedown pin and a detent-pin system (including a detent spring, and a detent pin received in a detent pin hole in the lower receiver). These components may be assembled/installed in both the lower and upper receiver, to create the beneficial connection and/or disconnection of the receiver's rear connection points as discussed above. Alternatively, the takedown pin assembly may be assembled/installed only in the lower receiver, without connection of the upper receiver, that is, without the pin being installed in the upper receiver pin hole. This installation only in the lower receiver may be done for storage of the lower receiver and takedown pin assembly as a unit, and/or prior to a later step of connecting the upper receiver. This is possible because the takedown pin assembly, by virtue of the detent system, may be pushed or pulled into, and temporarily held in, either the axially-disengaged position extending only into one sidewall portion of the rear coupler, or the axially-engaged position extending into both sidewall portions of the rear coupler, whether or not the upper receiver is connected by its rear knuckle being inserted into the rear coupler of the lower receiver and then being captured by the takedown pin. Therefore, at certain times, the operator will install the pin of a conventional takedown pin assembly in the lower receiver, in either the axially-disengaged position or the axially-engaged position, without the upper receiver being connected. For subsequent connection of the upper receiver, the operator simply maintains the takedown pin in, or axially pulls the takedown pin back to, the axially-disengaged position, inserts the upper receiver's rear knuckle into the rear coupler of the lower receiver, and then pushes the takedown pin to the axially-engaged position to complete the takedown pin assembly and connection of the upper and lower receivers. Therefore, one may describe the takedown pin assembly as being "assembled to" or "installed in" the lower receiver in certain cases, and as being, "assembled to" or "installed in" the lower receiver and upper receiver in other cases.

Considering the configurations, components, and methods of use for the takedown pin, lower receiver, and upper receiver, it is also important to consider their influence on the firearm's breach and its subsequent effect on the alignment and operation of the trigger hammer and firing pin of the firearm, as discussed above. For those familiar with firearms that are configured to use a lower and upper receiver and that are also properly assembled and in sound working condition, one may assume that, when the takedown pin is axially-engaged into the lower and upper receivers, the lower and upper receivers are securely coupled at their rear connection points, and, therefore, the breach of the firearm is in an operable mode because the trigger hammer and firing pin are in alignment and in position to discharge the waiting round. Conversely, when the takedown pin is axially-disengaged from the upper receiver and the receivers have been separated at their rear connection points, the breach of the firearm is in an inoperable mode as the trigger hammer and firing pin are no longer in alignment and/or able to interact; this inoperability due to lack of hammer and pin alignment may occur even if the rear connection points of the lower and upper receivers are only slightly separated. Conventional takedown pin, lower receiver, and upper receiver configurations, and methods of placing them into an inoperable position, are problematic, as they typically require the takedown pin to be axially-disengaged either partially or completely from the upper receiver in-order to allow the receivers to separate at their rear connection points, and this may be considered by operators to be an unsafe, cumbersome and/or tedious process to perform.

Further, axially-disengaging and/or engaging the takedown pin from and/or to the upper receiver may be inefficient, difficult, take excess time, and/or require excessive force to perform. In addition, when the takedown pin is disengaged from the upper receiver, thus allowing the lower and upper receivers to freely separate and pivot on the forward pivot pin hinge, it may be difficult and/or awkward for the operator to control the pivoting movements of the receivers. This difficulty or awkwardness may occur especially when the operator is trying to perform critical tasks, such as engaging and/or disengaging the magazine of the firearm while the breach of the firearm is in an open and inoperable position, which may be desired and/or necessary for some operators and/or firearm configurations.

As mentioned above, there are operators who desire and/or require the breach of certain firearm embodiments to be open and placed into an inoperable mode, in-order to perform critical tasks like engaging and/or disengaging the magazine to and/or from the firearm. When tasks like this are performed, it is important the operator of the firearm can perform the tasks needed in a safe and controlled manner, which may be hindered by: 1) the conventional process of axially-engaging and/or axially-disengaging the takedown pin from the upper receiver, and 2) the resulting potential of uncontrolled and awkward pivoting movements of the firearm when the rear connection points of the lower and upper receivers are no longer being controlled by the takedown pin.

Furthermore, these concerns regarding conventional takedown pins and receivers are more likely and/or more serious when the processes are performed under stressful and/or adverse conditions, which is likely the case when performed by military, law enforcement or other operators needing to perform these tasks in the field. Thus, there is a need to improve and/or simplify the conventional process of securing, semi-securing, and/or unsecuring the rear connection points of the lower and upper receivers. Embodiments of the invention meet one or more of these needs, as will be further understood from the following disclosure and discussion.

SUMMARY

The invention is a takedown pin system, and/or methods of using the takedown pin system, that comprise a takedown pin configured to function with known and/or specially-modified firearm lower and upper receivers, to enhance the ability of an operator to secure, semi-secure, and/or unsecure the rear connection points of the lower and upper receivers. In preferred embodiments, the takedown pin system is adapted so that the takedown pin need not be axially-disengaged from the upper receiver in order to open the lower and upper receivers to an extent that makes the firearm inoperable. In certain embodiments, the takedown pin and the upper receiver are both specially-adapted to fully open, partially open, and fully close the breach of the firearm by unsecuring, semi-securing, and securing, respectively, the rear connection points of the lower and upper receivers.

Compared to prior takedown pin and upper receiver configurations, certain embodiments of the invention are particularly beneficial due to simplicity and a reduction of steps that are needed to place the breach of the firearm in an open and inoperable, and/or closed and operable mode. Compared to prior takedown pin and upper receiver configurations, certain embodiments of the invention may simplify, reduce the steps, increase the safety, and/or reduce the uncontrolled and awkward movement of the receivers when they are separated at their rear connection points.

Certain embodiments comprise an improved/modified takedown pin, an improved/modified upper receiver, and/or a combination of said pin and upper receiver in a firearm. The takedown pin is adapted to have a recess, flange, or other reduced-dimension/diameter main body portion, that, upon rotation into an appropriate position, is positioned in the rear knuckle in such a way that it allows the rear knuckle of the upper receiver to move/slide relative to the pin into/along the recess/reduced-dimension portion. This relative movement/sliding of the rear knuckle and the pin result in a semi-secure connection, or a "partial engagement", between the rear connection points of the lower and upper receivers, wherein the lower and upper receivers are allowed to pivot relative to each other, to an extent that nominally/slightly separates and opens them, that is, separates and opens them in a limited and controlled manner. In certain embodiments, the amount that the lower and upper receivers in the semi-secured condition are allowed to pivot relative to each other may be in the range of 0.1 to 3.0 degrees. This amount of pivoting may be accomplished by modifying certain prior art takedown pins, for example, those of about 0.25 inches in diameter, to have a reduced-dimension/diameter portion. This amount of pivoting also may be done: 1) without modifying the diameter of conventional takedown pin assembly holes, or 2) without modifying the diameter of the conventional holes, but with addition of a slot and/or recess in the inner surface of the assembly hole. The reduced-dimension portion in certain embodiments may comprise a recess that receives a portion of the rear knuckle pin-hole surface to allow the rear knuckle to shift in location relative to the pin and, hence, relative to the lower receiver in which the pin is retained. The reduced-dimension portion in certain embodiments may comprise a narrow flange that moves/slides into a recess or slot in the rear knuckle pin-hole surface to allow the rear knuckle to shift in location relative to the pin, and, hence, relative to the lower receiver in which the pin is retained. The proximal and distal end portions of the pin are retained in the lower receiver pin holes due to said end portions each having a diameter very close to (only slightly less than) the lower receiver pin hole diameters; therefore, the proximal and distal end portions are held in the lower receiver pin holes so that the pin is rotatable in those lower receiver pin holes on the pin longitudinal axis, the pin is generally or substantially immovable in a radial direction inside the lower receiver pin holes even when rotated.

The takedown pin system and methods allow the pin to be rotated while it is fully axially-engaged with the lower and upper receivers. This is an important distinction between prior takedown pin configurations, because it allows the takedown pin to affect full or partial engagement of the lower and upper receivers, depending on the rotational positioning of the takedown pin, without the pin needing to be axially pushed or pulled in the direction of the longitudinal axis of the pin. In certain embodiments, therefore, the takedown pin system moves between three important positions while being in the axial pin hole(s) of the lower and upper receivers, specifically unsecured, secured, and semi-secured positions, solely by rotation of the takedown pin in the axial hole(s) in the lower and upper receivers. Therefore, in certain embodiments, a modified detent track system is provided on the takedown pin that allows rotation of the pin when in the fully axial-engaged position, for example preferably rotation of at least 180 degrees.

Further description, advantages and important aspects of the preferred takedown pin and upper receiver will be further explained using the provided Detailed Description and Drawings below. Upon reviewing the following Detailed Description and the Drawings, one of average skill in this field will understand how to apply the invention in various firearms of many types, and will understand that further modifications and alternative embodiments of various aspects of the invention(s) may be apparent to those skilled in the field.

DETAILED DESCRIPTION OF CERTAIN EMBODIMENTS

Figure 1A:
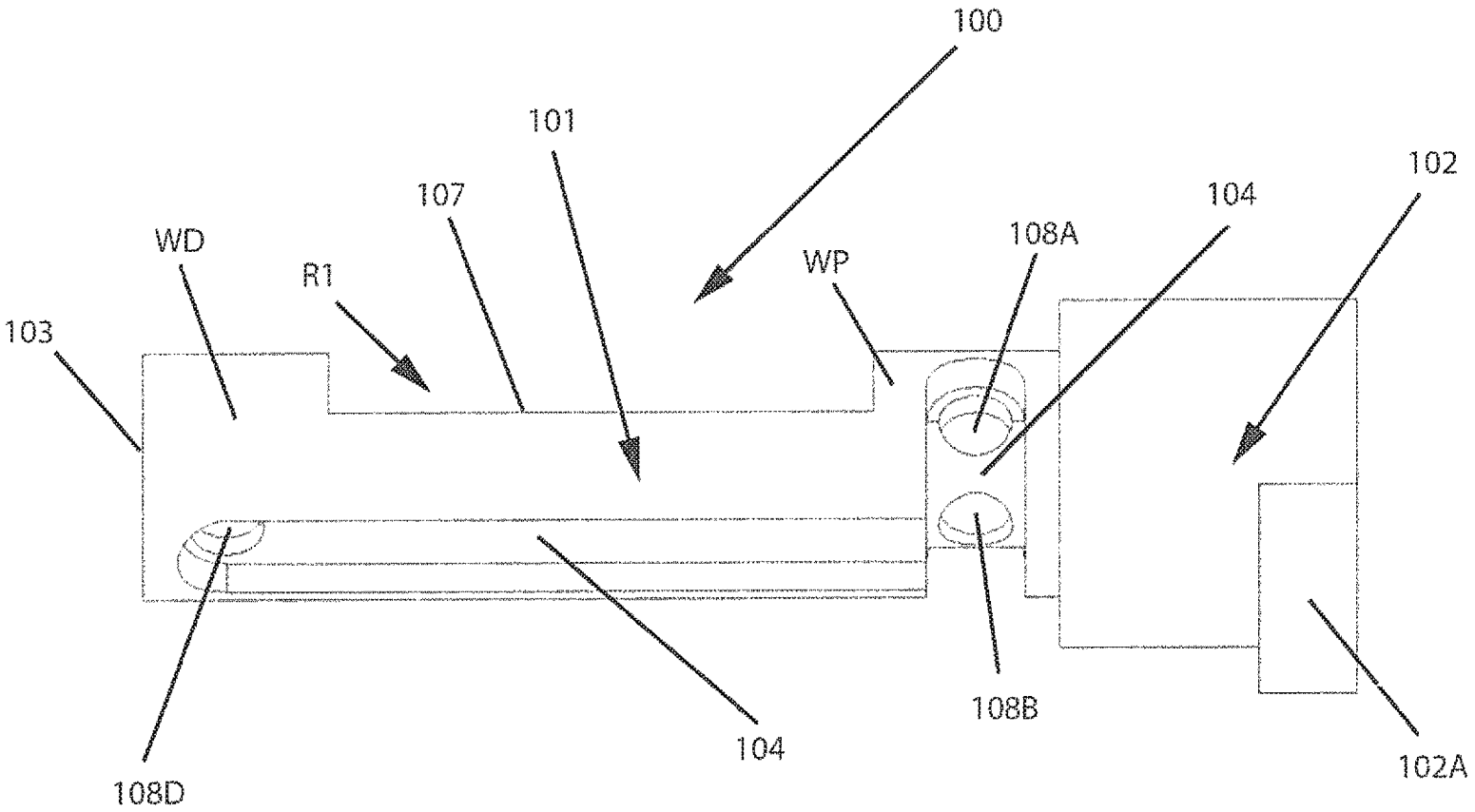
FIG. 1A is a side view of one embodiment of the invented takedown pin configured to function with a conventional firearm having upper and lower receivers.

The aspects of the disclosed devices, and the enhanced engagement and disengagement, assembly and disassembly methods/processes, relate to a takedown pin and receiver system used for firearms. The disclosed takedown pin is an assembly pin configured to "secure", "semi-secure", and/or "unsecure" the upper receiver rear connection point, herein called the "rear knuckle", to and/or from the lower receiver rear connection point, herein called the "rear coupler". The takedown pin and receiver assembly may be used for a large number of firearm configurations, but the exemplary firearm platform provided herein is that of an AR15 style firearm. Considering the popularity of this type of firearm platform, few of the conventional aspects of the takedown pin, upper receiver, and/or the lower receiver will be detailed in writing herein, with the focus instead being on novel aspects of the takedown pin and/or a modified upper receiver system. Furthermore, those familiar with firearms will recognize that alternative embodiments and/or methods may be created and/or performed wherein the basic principles of design and operation of the takedown pin and upper receiver system are the same or similar. Noting that there may be many variations of the takedown pin and/or the upper receiver, several, but not all, embodiments are detailed below.

In certain embodiments, the takedown pin is configured to function with conventional lower and upper receivers. These embodiments do not require modification of the upper receiver rear knuckle, specifically, they do not require modification of the generally cylindrically-shaped assembly hole in the rear knuckle. In certain alternative embodiments, the takedown pin is configured to function with a conventional lower receiver and a modified upper receiver, specifically an upper receiver that comprises a modified rear knuckle.

In the takedown pin system portrayed in FIGS. 1A-C, 2, 3A and B, 4A and B, and 5A-C (hereafter "FIGS. 1-5"), the takedown pin is configured to have a generally-cylindrical main body, a positioning pin head end, an opposing distal pin end, a detent track recessed into the pin, and a reduced-diameter mid-section that may be described as a recess in the main body. The detent track may begin near the distal end and run axially, linearly, and proximally toward the positioning pin head end. The detent track may comprise one or more circumferential detent track portions. In certain embodiments, a proximal, circumferential detent track portion is provided near the proximal end of the takedown pin; this way, the detent track changes direction from axial to circumferential, to continue in one or both directions partially or completely around the circumference of the takedown pin. The takedown pin may comprise one or more detent dimples recessed into the floor of the detent track, for example, preferably in the circumferential portion(s) of the track.

Therefore, the takedown pin shown in FIGS. 1-5 may be axially-pushed and/or axially-pulled when the detent pin is engaged in the linear/axial section of the detent track, and also the takedown pin may be rotationally turned when the detent pin is engaged in the circumferential section(s) of the detent track. Therefore, it should be noted that this takedown pin configuration allows the pin to be rotated while it is fully axially-engaged with the lower and upper receivers. This is an important distinction from prior art takedown pin configurations, because it allows the takedown pin to achieve full ("secure") or partial ("semi-secured") engagement of the lower and upper receivers, depending on the rotational positioning of the takedown pin, without the axial-adjustment of the pin that is required for prior art takedown pins.

The recess of the pin of FIGS. 1-5, is configured so that, when the pin is appropriately rotated, the rear knuckle can slide into or "couple" with the recess, allowing the upper receiver to slide/pivot upward slightly relative to the lower receiver rear coupler. Thus, the recess provides one embodiment of a semi-secure connection between the rear connection points of the lower and upper receivers, wherein the rear connection points of the lower and upper receivers are still connected but are slightly separated to be "open" in a limited and controlled manner.

The recess is preferably on the opposite side of the generally-cylindrical main body from the axial/linear section of the detent track. This way, the axial/linear detent track extends axially past the recess to reach the "clockwise and/or counter-clockwise" circumferential track portion that may be described as "running 90 degrees" in either one or both directions from the axial/linear track portion.

In certain embodiments comprising the "clockwise and/or counter-clockwise" circumferential detent track portions, and assuming the takedown pin is properly assembled to the lower receiver and axially-engaged with both the lower and upper receivers in the unsecure position, the axial/linear section of the detent tract is facing toward the rear of the firearm and the detent pin is urged by the spring of the detent pin assembly into the detent track to be temporarily held at the intersection of the axial/linear and circumnavigating detent track portions. From this position, at the intersection, the takedown pin is able to be rotated in either a clockwise or counter-clockwise direction. If the takedown pin is rotated 90 degrees in a counter-clockwise direction, the axial/linear section of the detent track faces downward, and the lower and upper receivers are secured and not allowed to separate at their rear connection points, in other words, the receivers are in the secured position. Conversely, if the takedown pin is instead turned 90 degrees in a clockwise direction, the recessed section of the takedown pin faces downward; in this position, the rear knuckle of the upper receiver may slide upwards toward/into the recess, so that the upper receiver raises slightly relative to the lower receiver, and the upper and lower receivers separate a small distance at their rear connection points and so are in the semi-secured position. This semi-secure position is differentiated from full separation of the rear connection points and full opening of the lower and upper receivers, wherein, in this embodiment, the takedown pin needs to be fully axially-disengaged from the upper receiver in order for the lower and upper receivers to fully separate at their rear connection points.

In the alternative embodiment(s) portrayed in FIGS. 6A-C, 7, 8A and B, 9A and B, and 10A-D (hereafter, "FIGS. 6-10"), the takedown pin and the rear knuckle of the upper receiver are both modified and configured to work together as a system. In certain embodiments of this combination/configuration, the pin may be installed in an unsecure rotational orientation prior to closing the lower and upper receivers, and left in said unsecure rotational orientation for opening of the lower and upper receivers. Upon rotation of the pin from said certain rotational orientation, the secured and semi-secured conditions may be achieved without pulling/retracting the pin from the upper receiver. Therefore, although a linear section of detent tract may be used, it may not be necessary in all embodiments in-order for the takedown pin to secure, semi-secure, and unsecure the rear connection points of the lower and upper receivers.

The takedown pin, in FIGS. 6-10, that cooperates with a modified upper receiver rear knuckle, may have a generally-cylindrical main body, a positioning pin head end, an opposing distal pin end, one or more detent tracks/track-portions recessed into the pin, and a reduced-diameter mid-section that may be described as a flange formed/cut in the main body. Preferably, said one or more detent tracks/portions comprise a track portion that circumnavigates, either partially or completely, around the main body near to the positioning pin head end. The detent track may contain one or more detent dimples recessed into the floor of the detent track. The flange is in a mid-section of the main body and may comprise a lip or other stop to catch/stop the takedown pin from fully passing through the slot (or "aperture") of the modified rear knuckle of the upper receiver when the pin is in the semi-secured position.

A modified rear knuckle, cooperating with the takedown-pin of FIGS. 6-10, may be generally cubically shaped and located near the rear end of the upper receiver in a downward facing position so that it may be pivoted into and/or pivoted out of the rear coupler of the lower receiver. The rear knuckle may comprise a mostly cylindrical assembly hole, which contains a recess and/or slot-like configuration cut into and/or through the base of the rear knuckle. This recess and/or slot may comprise a flat or generally flat edge, and a lipped edge opposite to the flat edge. The lipped edge is designed to catch/stop the takedown pin lip, so that the pin does not fully pass through the slot in the semi-secure position, allowing the lower and upper receivers to slightly separate at their rear connection points in a limiting and controlled manner.

Considering the embodiment comprising the pin and upper receiver rear knuckle combination described above and portrayed in FIGS. 6-10, the takedown pin is in the secure position when a flange side surface is facing downward, for example, extending horizontally across the hole of the rear knuckle. While in this secure position, the full diameter of the takedown pin, at the flange, spans horizontally across most of the diameter of the assembly hole, for example, with only about 1 to 2 thousandths of an inch between the full diameter of the pin and the pin hole due to machining tolerances. Thus, this full diameter of the pin at the flange provides a generally tight/snug fit in the pin hole, preventing any significant relative movement of the upper receiver and the pin; this therefore limits the upper receiver from pivoting upward and prevents the upper receiver from pivoting open and separating from the lower receiver at their rear connection points. While the takedown pin is in the above-described secure position, the takedown pin may be rotated, for example clockwise 90 degrees, into the "semi-secure" position, thus positioning the mostly flat, un-lipped surface of the flange facing towards the rear of the firearm and positioning the lipped surface of the flange facing toward the front of the firearm. While in this semi-secure position, the takedown pin's narrow flange end fits into the recess/slot in the rear knuckle of the upper receiver, so the upper receiver is allowed to move/pivot upward relative to the pin and the lower receiver. Thus, with the pin in this semi-secure orientation, the upper receiver can pivot open until the lip edge of rear knuckle abuts against and is stopped by the lip of the takedown pin, resulting in the receivers slightly separating in a limited and controlled manner.

Still considering the combination of the pin and upper receiver rear knuckle described above and portrayed in FIGS. 6-10, the unsecure and semi-secure positions of the pin are each about 90 degrees in opposite directions from the secure position. For example, from the secure position, the pin may be rotated counter-clockwise 90 degrees from the secure position, to enter the unsecure position. While in the unsecure position, the flange is vertical in the rear knuckle pin hole, and the upper receiver may move/pivot vertically up and down without catching on the flange or the flange lip, in other words, allowing the takedown pin to pass completely through the slot of the rear knuckle. However, from the secure position, the pin may be rotated clockwise 90 degrees from the secure position to enter the semi-secure position, wherein the flange is vertical and the flange lip extends forward, allowing limited movement of the upper receiver that is stopped/controlled when the slot lipped edge abuts against the flange lip.

Figure 6A:
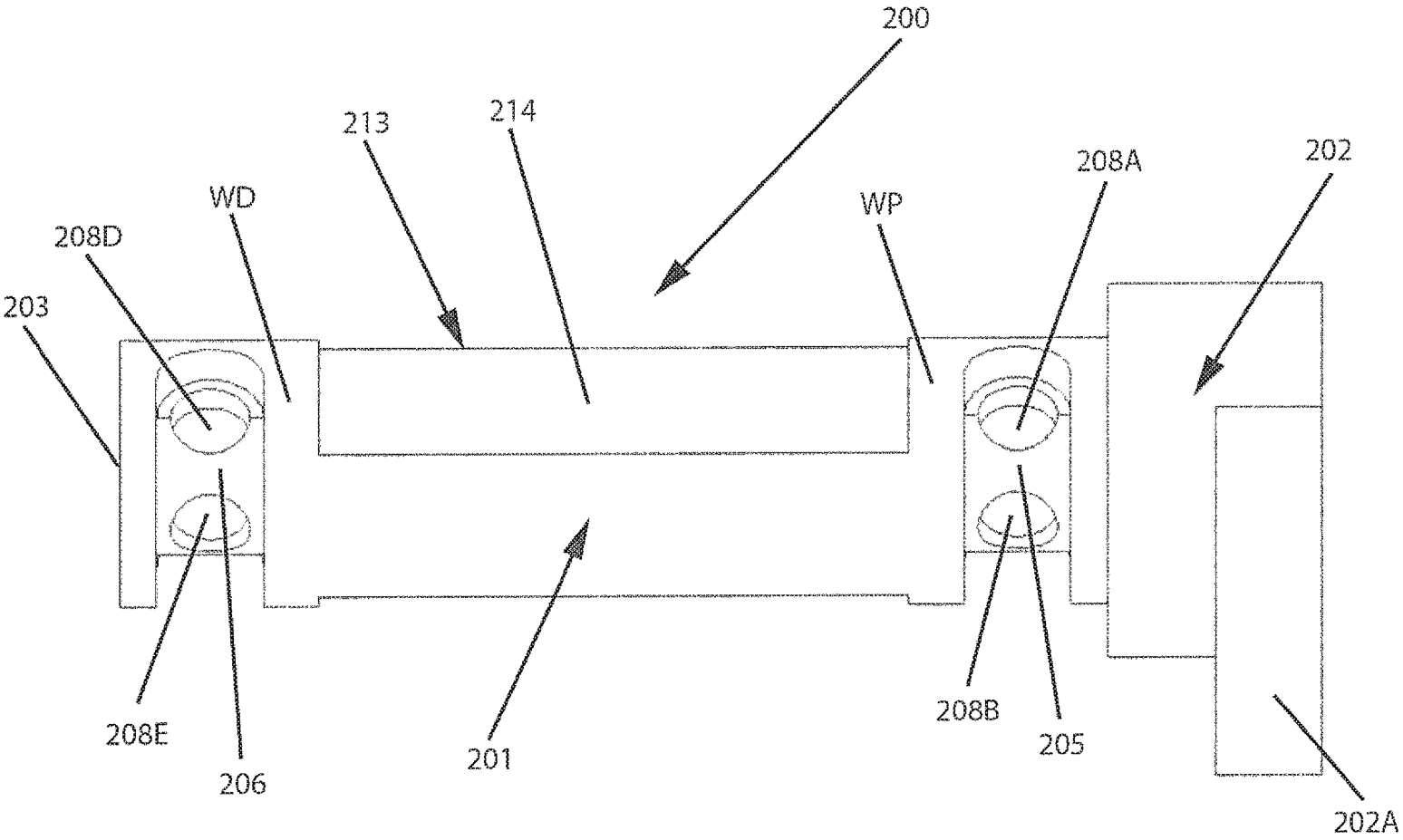
FIG. 6A is a side view of another embodiment of the invented takedown pin designed to function in a combination of a conventional lower receiver and a specially-modified upper receiver.
Figure 6B:
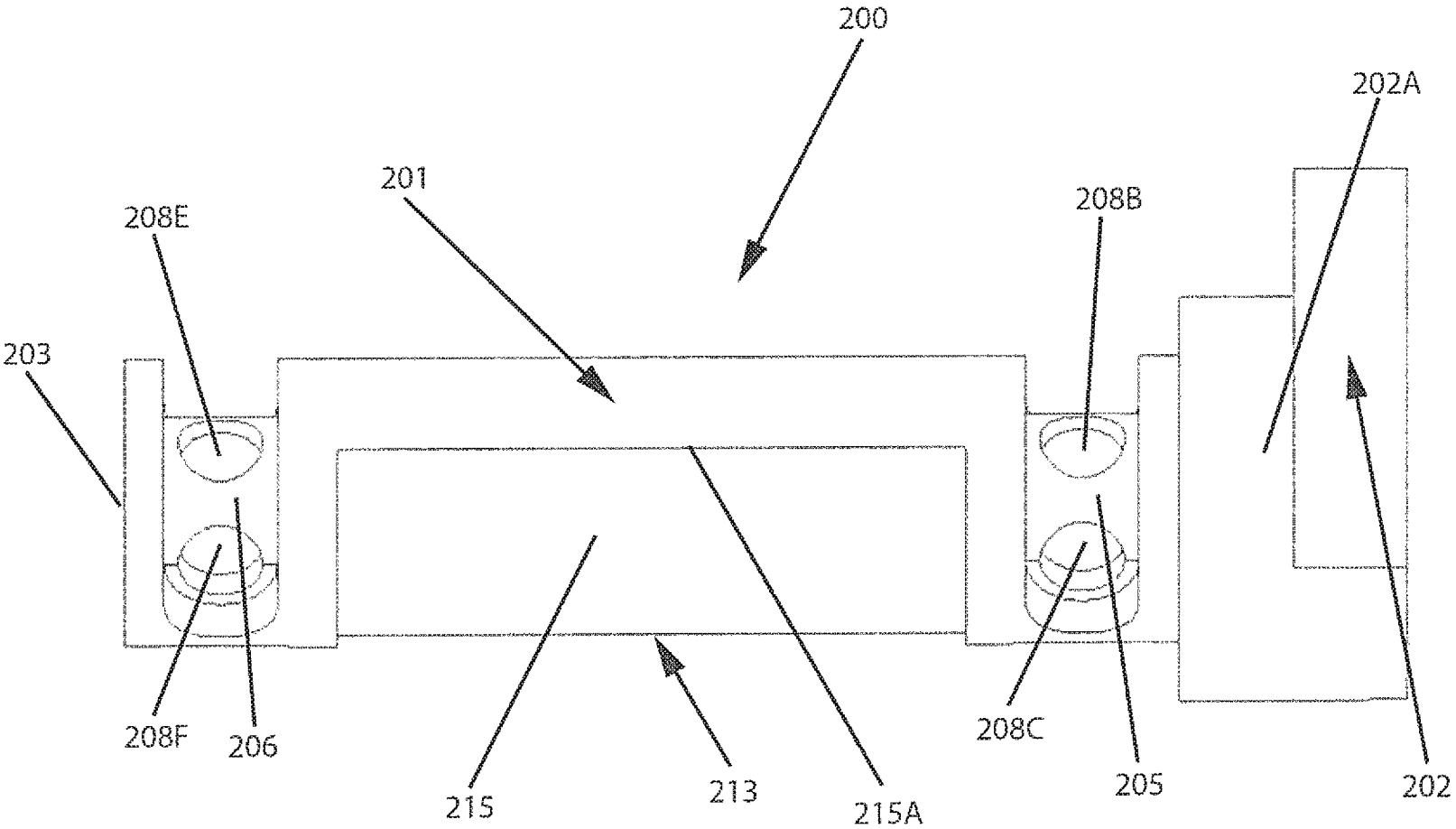
FIG. 6B is a side view of the pin of FIG. 6A, wherein the pin is rotated on its axis, away from the viewer, approximately 180 degrees from the pin orientation in FIG. 6A.
Figure 6C:
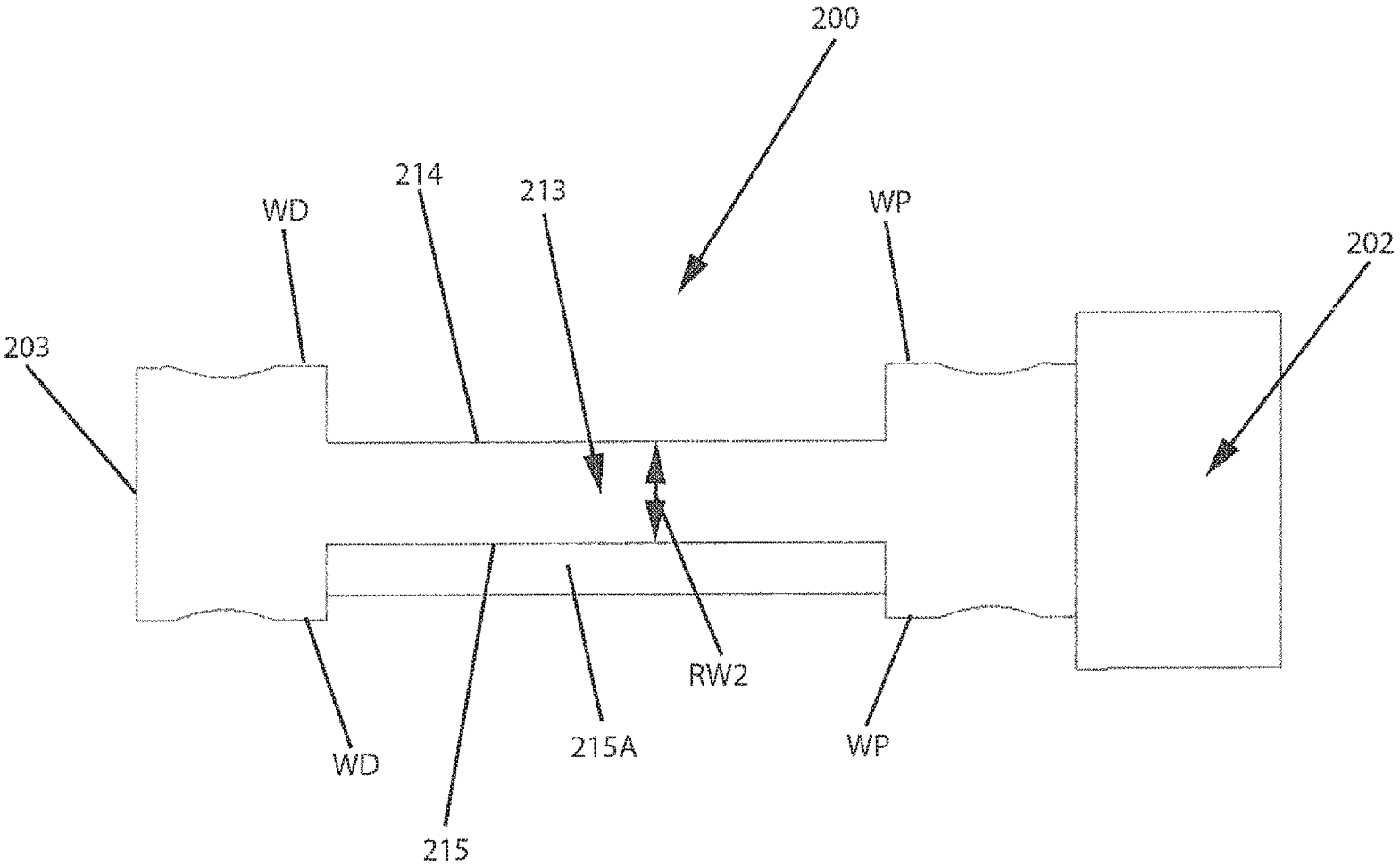
FIG. 6C is a side view of the pin of FIG. 6A, rotated on its axis farther away from the viewer, approximately 45 degrees from the pin orientation in FIG. 6B.

Yet another takedown pin and upper receiver configuration/combination, is shown in FIGS. 11, 12 and 13A-C, wherein the pin of FIGS. 6A-C is installed, unconventionally, from the left-hand side of the firearm. By providing the circumnavigating detent track discussed above, near the distal pin end, instead of, or in addition to, near the positioning pin head end, the takedown pin may be installed using the existing right-side, rear detent assembly hole of the lower receiver and conventional detent assembly, but with the positioning pin head end unconventionally installed/positioned on the left-hand side of the firearm. This exemplary takedown pin would require either the lipped edge of the takedown pin or the lipped edge of the rear knuckle to be swapped to the alternative side of the pin flange or rear knuckle slot, respectively, but once assembled, the takedown pin would function similarly to the previously-described takedown pin and upper receiver system of FIGS. 6-10. This left-handed system may be useful for operators who shoot left-handed and/or prefer to operate the takedown pin rotational positioning from the left-hand side of the firearm.

In an effort to clarify and differentiate, it will be understood by those of skill in the field of firearms, upon reading and viewing this disclosure, that the invented takedown pins disclosed herein are different and inventive compared to existing prior art safety-selector pins that may be used in AR15 style firearms. The disclosed takedown pins differ in shape/structure, dimensions, and function, compared to safety-selector pins of AR15 style firearms, for example, with the safety-selector pins being designed to cooperate with the trigger component group and place said trigger component group into a desired mode of function. Specifically, the normal modes of safety-selector pins are generally known as "fire" (which generally means the trigger component group is ready to fire the firearm when the trigger is depressed), "safe" (which generally means the trigger component group is locked and cannot be induced to fire), and/or for some firearm configurations, there may be a "burst" or "auto" option (which generally means the trigger component group is ready to fire one or more rounds while the trigger is continuously depressed). Furthermore, it is also important to recognize that the mechanics of a safety-selector pin are not reliant on the positioning and/or engagement of (or with) the upper receiver, and/or the safety-selector pin does not have direct control of the positioning of the upper receiver and/or the components assembled within it. The safety-selector pin and trigger component group are installed in the lower receiver, and the modes of the safety-selector pin can function with or without the upper receiver being engaged and/or disengaged from the lower receiver.

Figure 1B:
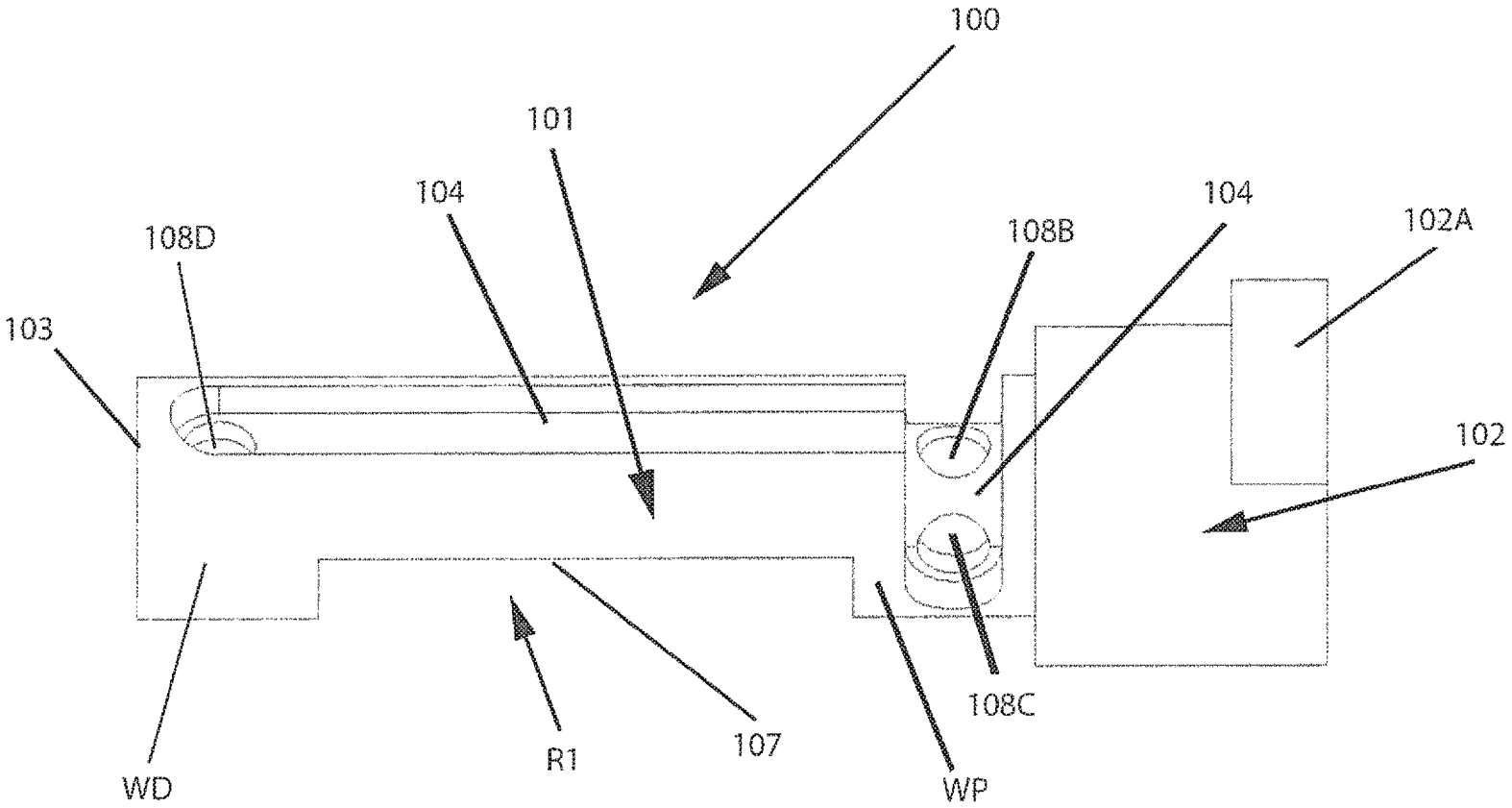
FIG. 1B is a side view of the pin of FIG. 1A, wherein the pin is rotated on its longitudinal axis, away from the viewer, approximately 180 degrees from the pin orientation shown in FIG. 1A.
Figure 1C:
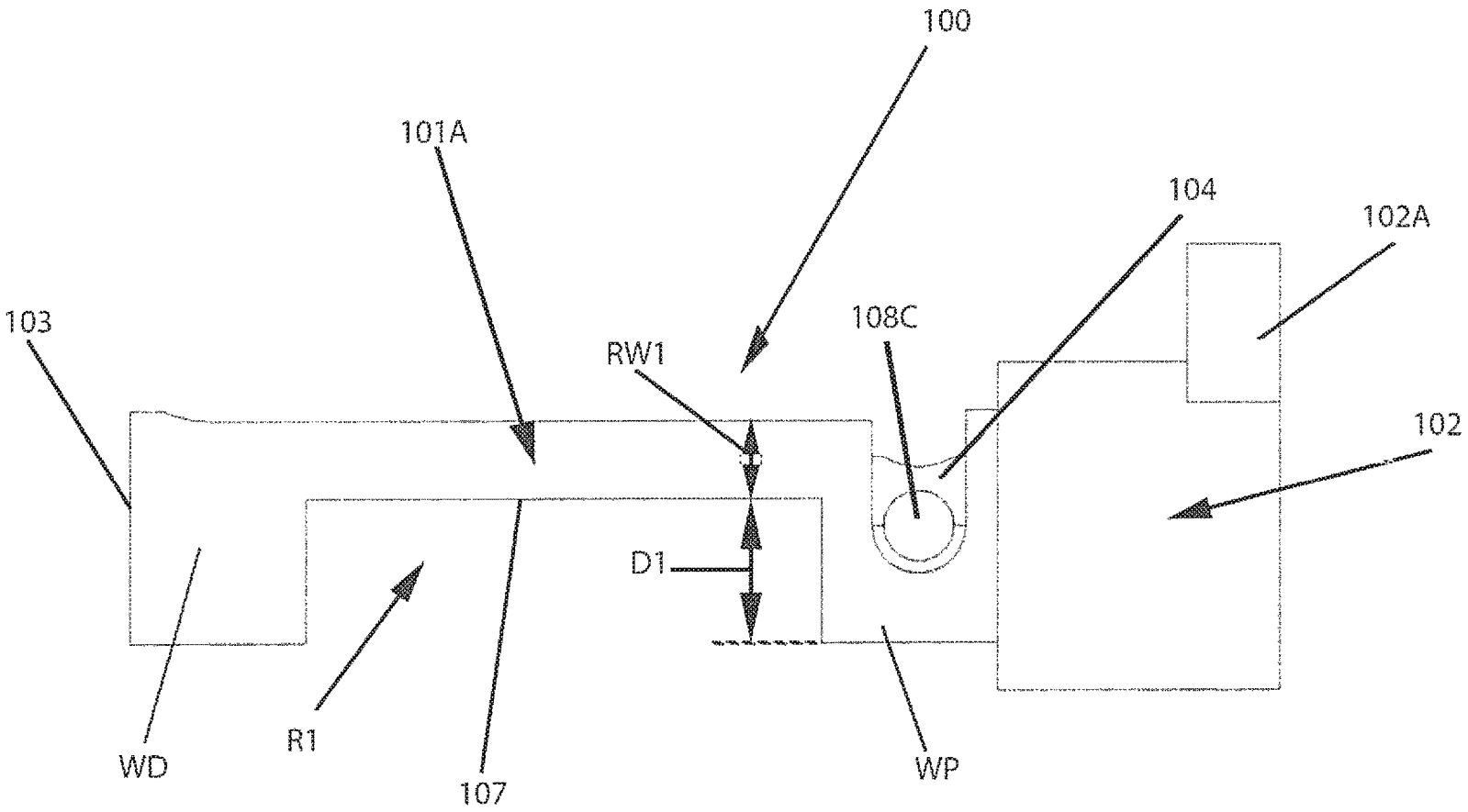
FIG. 1C is a side view of the pin of FIG. 1A, rotated away from the viewer, on its axis, another approximately 45 degrees from the pin orientation in FIG. 1B.

Referring Specially to the Figures:

The first portrayed embodiment of the takedown pin configuration, shown separate from any cooperating receiver in FIGS. 1A-C, illustrates the takedown pin 100 in three side views wherein the pin 100 has been rotated on its longitudinal axis different amounts, for example, as it may be rotated inside the rear connections points of a lower and upper receiver combination, which may be in certain embodiments conventional/prior-art lower and upper receivers. For example, the pin 100 is designed to be conventionally assembled to a conventional/prior art lower receiver 110 and to axially engage and/or disengage to and/or from the rear knuckle 112 of a conventional/prior-art upper receiver 109. In addition, and un-conventionally, the takedown pin 100 may also be designed to rotate in a clockwise and/or counter-clockwise direction while remaining in the fully axially-engaged position, so the operator may manually change the takedown pin 100 from the axially-engaged position, which may also be considered the unsecure position, to the secure and/or to the semi-secure positions.

The pin 100 comprises a generally/mainly cylindrical main body 101, a cylindrical positioning pin head end 102, radially-protruding handle 102A that acts as both a tactile head to help the operator manually grip and manipulate the pin as well as a visual indicator depicting what mode/position the pin 100 is in, and a cylindrical distal pin end 103 that helps guide the pin 100 into and/or out of the takedown assembly hole 111 of the rear knuckle 112. A recess/flange surface 107 is formed in a mid-section of the main body by cutting/forming recess R1 into the mostly cylindrical main body 101. The flange surface 107, and particularly the recess R1, cooperates with the rear knuckle 112 of the upper receiver 109. As discussed further below, and as shown in the drawings, when the pin 100 is rotated to the semi-secure position, the flange surface 107 faces downward and is horizontal or generally horizontal in the hole 111 of the rear knuckle 112. Said recess R1 provides sufficient room/space below the pin 100, so that the pin 100 can move downward relative to the hole 111 (or the upper receiver can move upward relative to the mid-section of the pin 100), for example, until the rear knuckle is "fully seated" in the recess, that is, until at least a portion of flange surface 107 contacts at least a portion of the lower inner surface of the hole 111 defining the lower portion of the hole 111, to stop movement/pivoting of the upper receiver relative to the pin 100. Thus, the pin 100 and the upper receiver hole 111 can move relative to each other a distance that is close to distance D1 (the curvature of the lower inner surface of hole 111 affecting the exact distance of downward sliding, so it will probably be slightly less than distance D1). In effect, this allows the pin to be lower in the hole 111 so that the upper and lower receivers may pivot apart a small, but significant, distance. In other words, the full-diameter distal portion/section WD ("wide distal portion") of the pin 100 main body 101 and the full-diameter proximal portion/section WP ("wide proximal portion") of the pin 100 main body 101 maintain the pin's position in the lower receiver, wherein the longitudinal axis of the pin 100 is coaxial with the axis of the lower receiver rear coupler and the pin does not shift up or down in the rear coupler. However, the knuckle 112 can move relative to the recesses mid-section of the pin 100, until the surface 107 of the recess R1 contacts a portion(s) of the lower inner surface of the knuckle hole 111. Therefore, the upper receiver and the lower receiver can separate slightly at their rear ends, and, while the pin 100 remains in both the upper receiver knuckle 112 and the lower receiver rear coupler. In this semi-secured position, the knuckle hole 111 is no longer axially aligned with the longitudinal axis of the pin 100 and the rear coupler holes, and the lower and upper receivers are slightly opened, but not allowed to entirely open.

In certain embodiments, when the firearm is properly held by the operator in an upward and standard operating position and the takedown pin is in the semi-secure position, the weight of the upper receiver 109 plus the connected barrel (not shown but understood by those of skill in the art) will have a center of gravity influenced by gravity, and gravity will naturally cause the upper receiver 109 to pivot on the forward pivot hinge, causing the rear connection points of the lower and upper receivers to separate until the rear knuckle 112 is fully seated into the recessed flange 107, as discussed above. Therefore, in many embodiments, the upper receiver 109 will tend to pivot up and forward relative to the lower receiver and pin, when the pin is placed in the semi-secure position. However, it will be understood from this document and the drawings that, in most embodiments, pivoting of the upper receiver up from the lower receiver and pin, or pivoting of the lower receiver and the pin down from the upper receiver, will perform and look the same or generally the same for the purposes of this discussion.

Therefore, recess R1 and the flange surface 107 forming it may be described as one example of a reduced-diameter or otherwise reduced-width portion of the takedown pin in a mid-section (axially-generally-central region) of the pin, for providing room for the lower receiver and pin to shift lower together relative to the knuckle 112 and hence relative to the upper receiver. This reduced-diameter/width pin portion allows the lower receiver to move/pivot slightly, but not entirely, away from the upper receiver, while the pin remains in the axial holes of both the upper and lower receivers. Thus, the receivers are held in a "semi-secured" position wherein the receivers are not fully open and the firearm is not operable, which may be desirable and/or required for some firearm apparatus and/or methods. The detent track system 104, which may comprise both a linear and circumnavigating (circumferential) section recessed into the takedown pin 100, helps guide the movements of the takedown pin 100 by virtue of the detent-spring and detent-pin system DP. The preferred detent track system 104 has an axial/linear section, which at its proximal end intersects, at or near to 90 degrees, a circumferential portion that circumnavigates around the takedown pin 100 either partially and/or completely around the mostly cylindrical main body 101. Takedown pin 100 also comprises one or more detent dimples 108, which may be recessed into the floor of the detent track system 104. The preferred detent dimple(s) are utilized to help temporarily hold takedown pin 100 in certain positions until enough force is applied to the takedown pin 100 to dislodge the detent-spring and detent-pin system DP from a given currently-engaged detent dimple 108. For example, the preferred dimples 108 comprise first, second and third proximal dimples 108A, 108B, 108C circumferentially spaced in the proximal circumferential portion of the detent track 104, for guiding/temporarily holding the pin upon rotation between a secured, unsecured, and semi-secured position, as will be understood from the discussion below and/or the drawings. For example, the dimples 108 may also comprise a distal dimple 108D at the distal end of the axial/linear portion of the detent track 104, which may guide/temporarily hold the pin in the axially-disengaged position.

Figure 2:
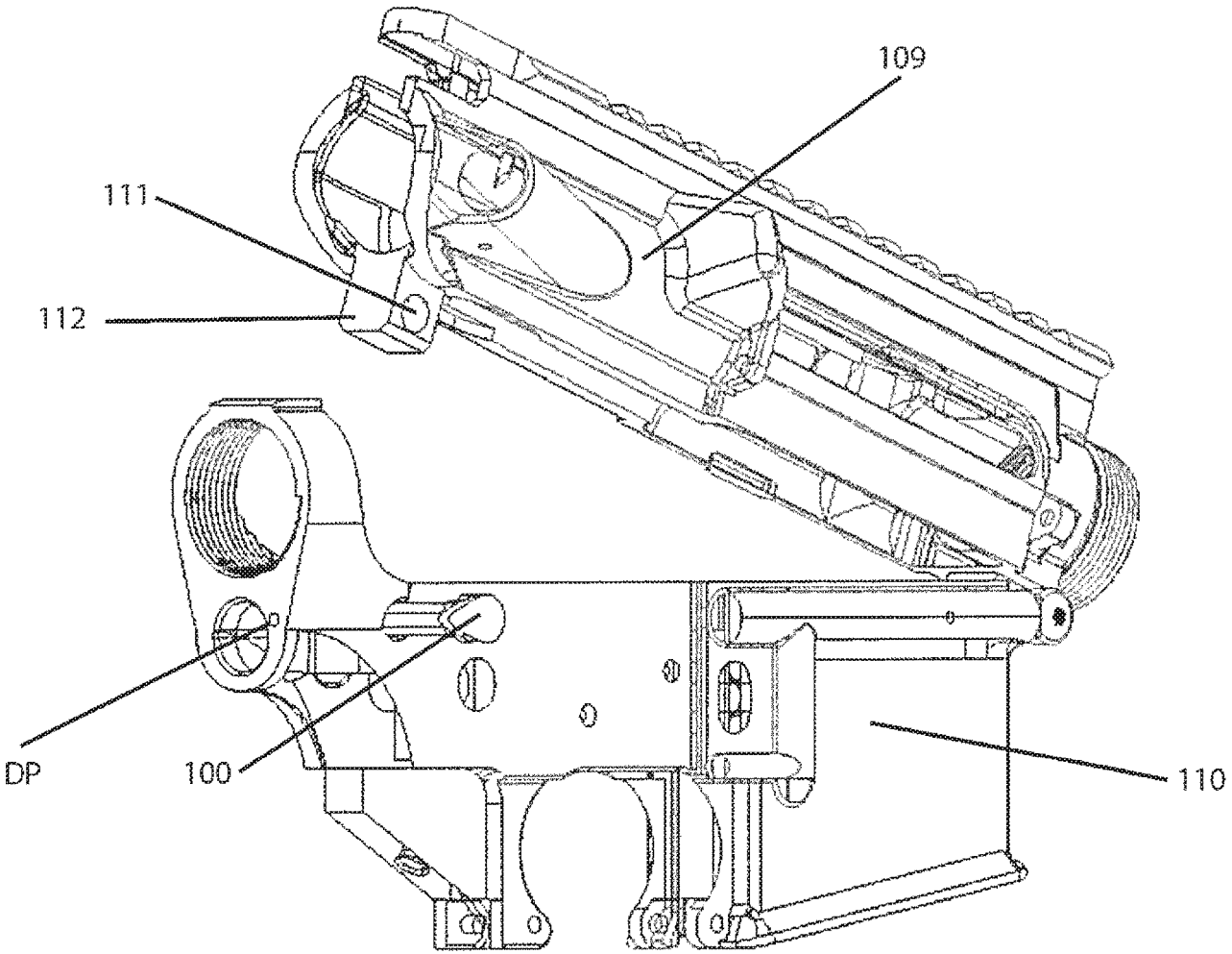
FIG. 2 is a rear right perspective view of a combination of an exemplary prior art lower receiver and upper receiver, pivoted apart to be fully separated at their rear connection points, and the pin of FIG. 1A partially inserted into the lower receiver rear coupler in the axially-disengaged position/condition.

Referring now to the rear right perspective view in FIG. 2, takedown pin 100 is assembled to a prior art lower receiver and temporarily held in the axially-disengaged position, wherein the distal end of the pin is inserted only as far as the right/proximal sidewall/portion of the lower receiver rear coupler. When in this axially-disengaged position, the upper receiver 109 may pivot open and fully separate from the prior art lower receiver 110 at their rear connection points. As depicted in FIG. 2, when fully separated, the rear knuckle 112 and its hole 111 can be seen. In addition, while the rear connection points of the upper and lower receivers are fully separated, the internal bodies of the receivers and the assembly pieces housed within them may be accessed for maintenance and/or replacement. Using this axially-disengaged position as a starting position, the following paragraphs discuss the process of placing the takedown pin 100 into the axially-engaged position, then secure position, and then the semi-secure position.

Figure 3A:
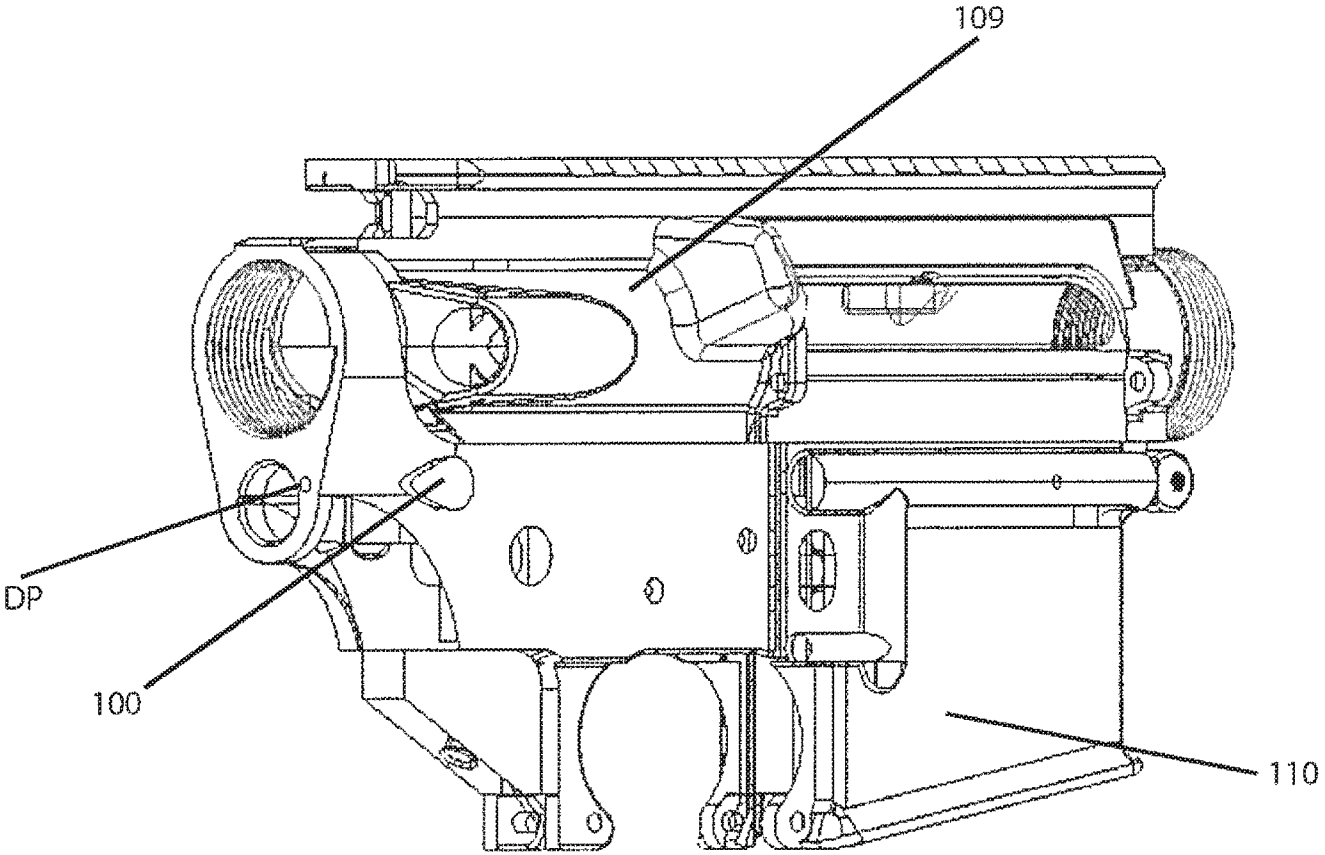
FIG. 3A is a rear right perspective view, which portrays the prior art lower and upper receivers of FIG. 2 pivoted closed and the takedown pin of FIG. 1A pushed/slid longitudinally/axially inward, relative to the pin's position in FIG. 2, to be held in the axially-engaged position in the rear coupler and the rear knuckle, of the lower and upper receivers respectively, in the position/condition herein referred to as the "unsecure" position.

Referring now to FIGS. 3A and B, takedown pin 100 is temporarily held in the axially-engaged and unsecure position. It may be considered an unsecure position for several reasons, for example, including: 1) that the takedown pin 100 may be easily repositioned into the axially-disengaged position by simply pulling the pin toward the right in FIG. 3A, to "back it out" of the receivers, and 2) that, if the recess R1 of pin 100 is formed/cut more than half way through the diameter of pin 100, then the diameter/width of the reduced-dimension body region 101A, at the location of the recess R1, will not span the diameter of hole 111, which may result in: a) unwanted play/movement of the receivers that may affect the operation/safety of the firearm, and/or b) in certain embodiments, region 101A being so narrow that it is not sufficiently strong to secure the rear connection points of the lower and upper receivers to an extent desired by certain manufacturers and/or users.

To move the pin 100 from the axially-disengaged position of FIG. 2 to the axially-engaged position of FIG. 3A, the rear knuckle 112 of the upper receiver 109 is lowered into (in-between and coaxial with) the rear coupler of the exemplary prior art lower receiver 110. Then, the pin 100 is axially-engaged from right to left, by pushing-in the pin 100 into and through the takedown assembly hole 111, and continuing on into the left sidewall of the lower receiver 110 rear coupler until the takedown pin 100 is fully axially-engaged and in the position shown in FIGS. 3A and 3*b*.

For FIGS. 3B, 4B, and 5B and C, below, note that the prior art lower receiver 110 has been intentionally omitted to reveal and illustrate the relationship of the pin 100 with the takedown assembly hole 111 of the rear knuckle 112. Also, it should be noted that in FIGS. 3B, 4B, 5B and 5C, and other Figures showing the pin in radial cross-section, the distal full-diameter portion/section WD of the pin is visible behind the cross-sectional reduced-diameter/dimension mid-section of the pin, to illustrate that the full-diameter portions WD and WP will be inside, captured, and supported by the takedown pin hole inner surfaces of the sidewalls of the lower receiver rear coupler. Also, it should be noted that there is a gap shown between the pin full-diameter portion/section WD (and the other non-recessed portion(s) of the pin) and the takedown pin hole(s), but the gap is schematic and meant to delineate the pin from the surface of the hole(s); in actual construction, the gap between the surface of the lower receiver and upper receiver holes and the full-diameter portion/section WD and other non-recessed portions of the pin main body, will typically be very small, so that there is a snug/tight fit except at the recessed portions of the pin.

FIG. 3A shows the upper and lower receivers closed, the pin 100 fully inserted and therefore axially-engaged, but in the temporarily unsecure position, and the radially-protruding handle 102A pointing rearward. While in this axially-engaged position, the detent spring and pin assembly may be temporarily held where the linear section of the detent track intersects with the circumnavigating section of the detent track in detent dimple 108B. See the enlarged detail view of the rear, lower portion of the upper receiver in FIG. 3B, showing to best advantage the upper receiver knuckle 112, the knuckle hole 111 formed by the inner surface of the hole 111 including the lower inner surface 111A of the hole 111, and a cross-section of the pin 100 viewed as if cut radially through the main body 101 at the main body region 101A comprising surface 107 and the recess R1. Note that the main body region 101A of the pin 100 in the knuckle 112 is small/narrow in diameter/width, because the surface 107 is formed/cut into the pin 100 to make the recess R1 extend into the pin a distance D1 that is greater than the radius of the full-sized portions WD, WP. In FIG. 3B, this small/narrow region 101A extends vertically or generally vertically near the rear inner surface 111B of hole 111, with a substantial space (recess R1) between region 101A and the front inner surface 111C of the hole 111.

From the position in FIGS. 3A and B, the pin may be rotated in a counter-clockwise direction (in a right side view looking at the handle 102A) approximately 90 degrees into the secure position (FIGS. 4A and B) or rotated in a clockwise direction (in a right side view looking at the handle 102A) approximately 90 degrees into the semi-secure position (FIGS. 5A-D).

Figure 4A:
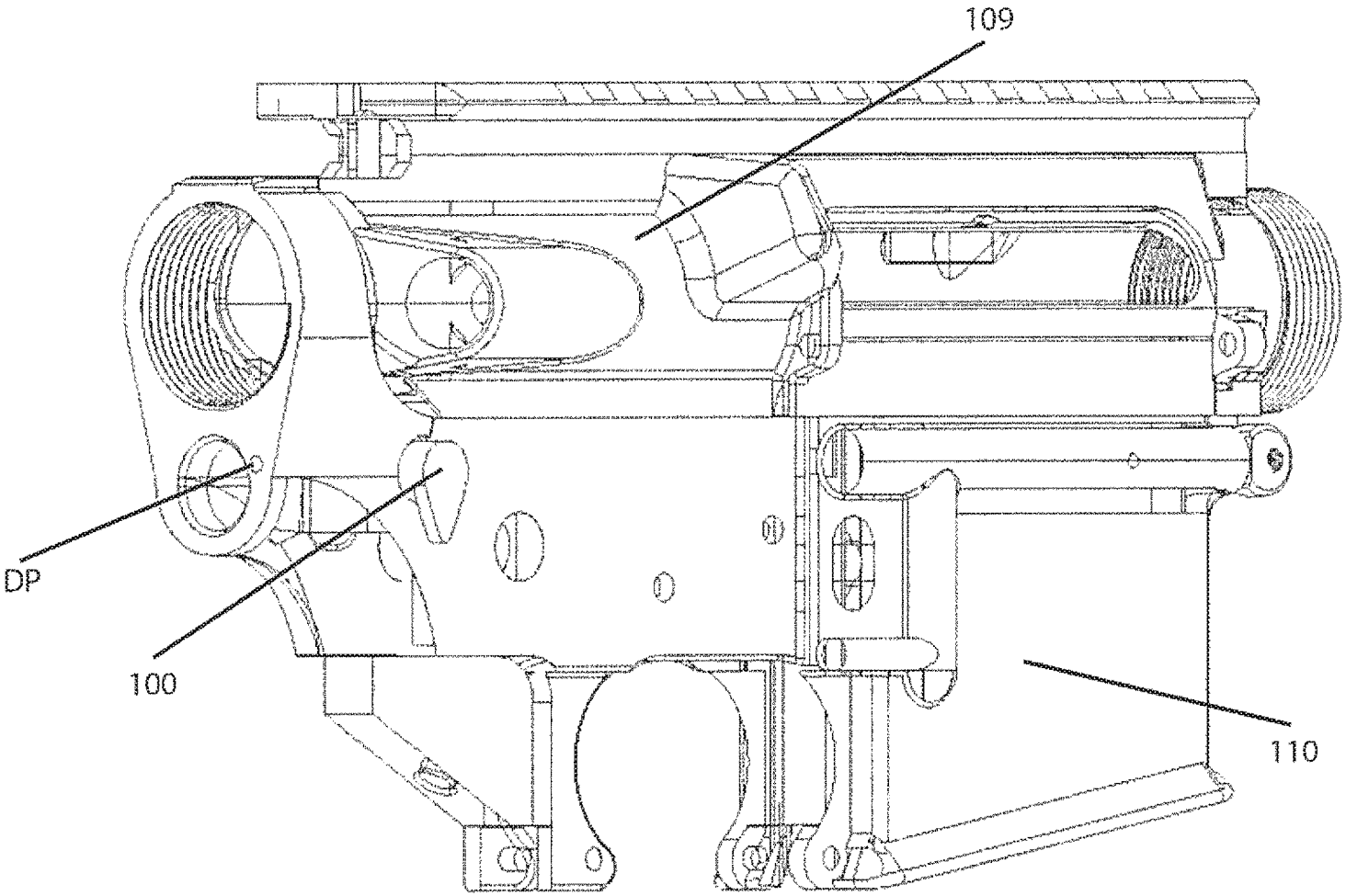
FIG. 4A is a rear right perspective view of the lower and upper receiver combination of FIGS. 3A and B, wherein the takedown pin is still axially-engaged but has been rotated counter-clockwise approximately 90 degrees from the position/condition of the pin in FIGS. 3A and 3B, into the position/condition referred to herein as the "secured" position.

Illustrating the secured position in FIGS. 4A and B, the takedown pin 100 has been rotated counter-clockwise approximately 90 degrees from the axially-engaged position of FIGS. 3A and B, into the secure position. While in this secure position, the pin 100 cannot be axially pulled or pushed and the rear connection points of the receivers are securely coupled together until the pin 100 is forcibly rotated back into the unsecure position of FIGS. 3A and B, or semi-secure position of FIGS. 5A-C that will be described below. Furthermore, it should be noted, that while the pin 100 is in this secure position, the firearm may be considered to be in an operable and safe-to-discharge mode.

Figure 3B:
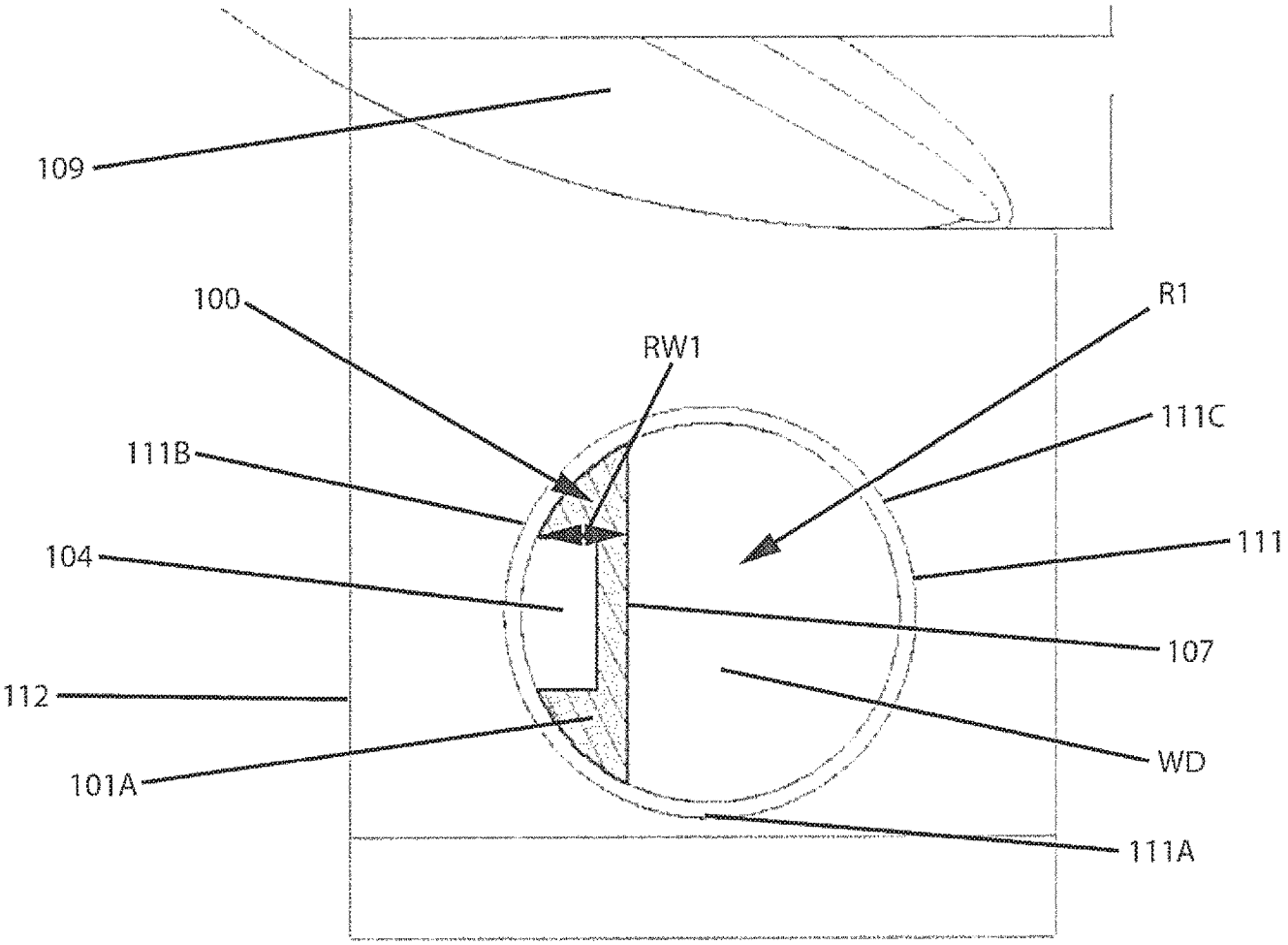
FIG. 3B is an enlarged right side detail view of the upper receiver of FIG. 3A with the pin shown in cross-section (through the mid-section of the pin) in the axially-engaged, unsecure orientation of FIG. 3A, but, for simplicity and to reveal the rear knuckle, without showing the lower receiver.
Figure 4B:
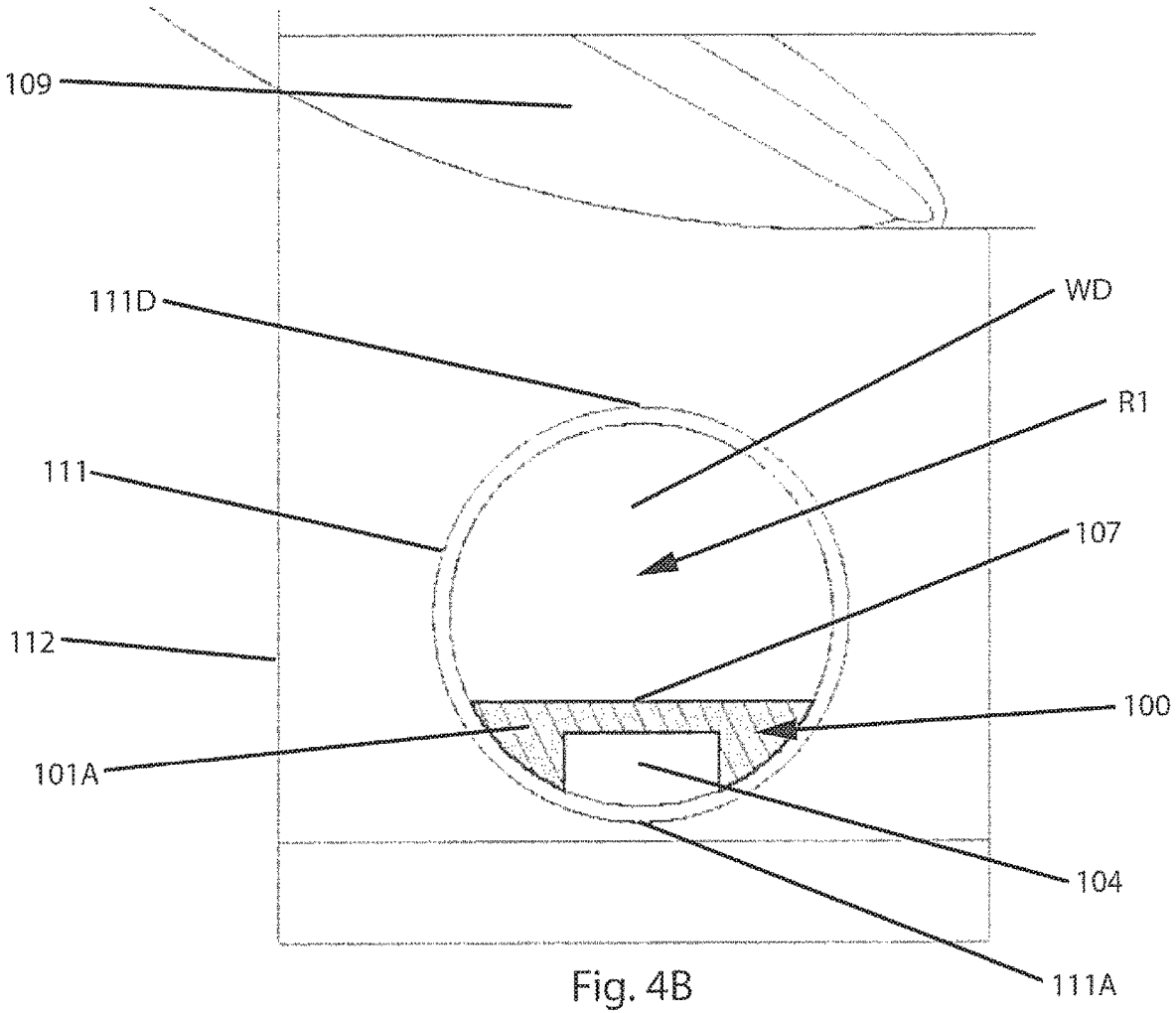
FIG. 4B is an enlarged right side detail view of the upper receiver of FIG. 4B with the pin shown a cross-section (through the mid-section of the pin) in the secured position of FIG. 4A, again without showing the lower receiver.

FIG. 4B is an enlarged detail view of the rear, lower portion of the upper receiver of FIG. 4A, including a cross-section of the pin 100 as in FIG. 3B, wherein the pin 100 has been rotated counter-clockwise 90 degrees. While in this position, the flange surface 107 of the pin 100 faces upwards and is horizontal or generally horizontal, and the small/narrow region 101A of the main body 101 extends horizontally or generally horizontally with the track 104 facing downward. Region 101A is near the lower inner surface 111A of hole 111 with a substantial space (recess R1) between region 101A and the top inner surface 111D of the hole 111. With the pin 100 thus-held in the hole 111 and in the rear coupler of the lower receiver (not shown but understood from this description based on a conventional lower receiver), the pin region 101A is held against the lower inner surface 111A, so that the lower receiver and the pin 100 cannot move down from the knuckle 112, and the upper receiver cannot move upward relative to the lower receiver and the pin 100. It will be understood that the recess R1 being at the top of the hole 111 does not result in the upper receiver pivoting downward toward the flange surface 107 and into the recess R1, because the receivers are already fully-abutting/fully-closed. Thus, in the position in FIGS. 4A and B, the receivers are in a coupled and secure position and will not pivot apart or pivot relative to each other in any way.

Figure 5A:
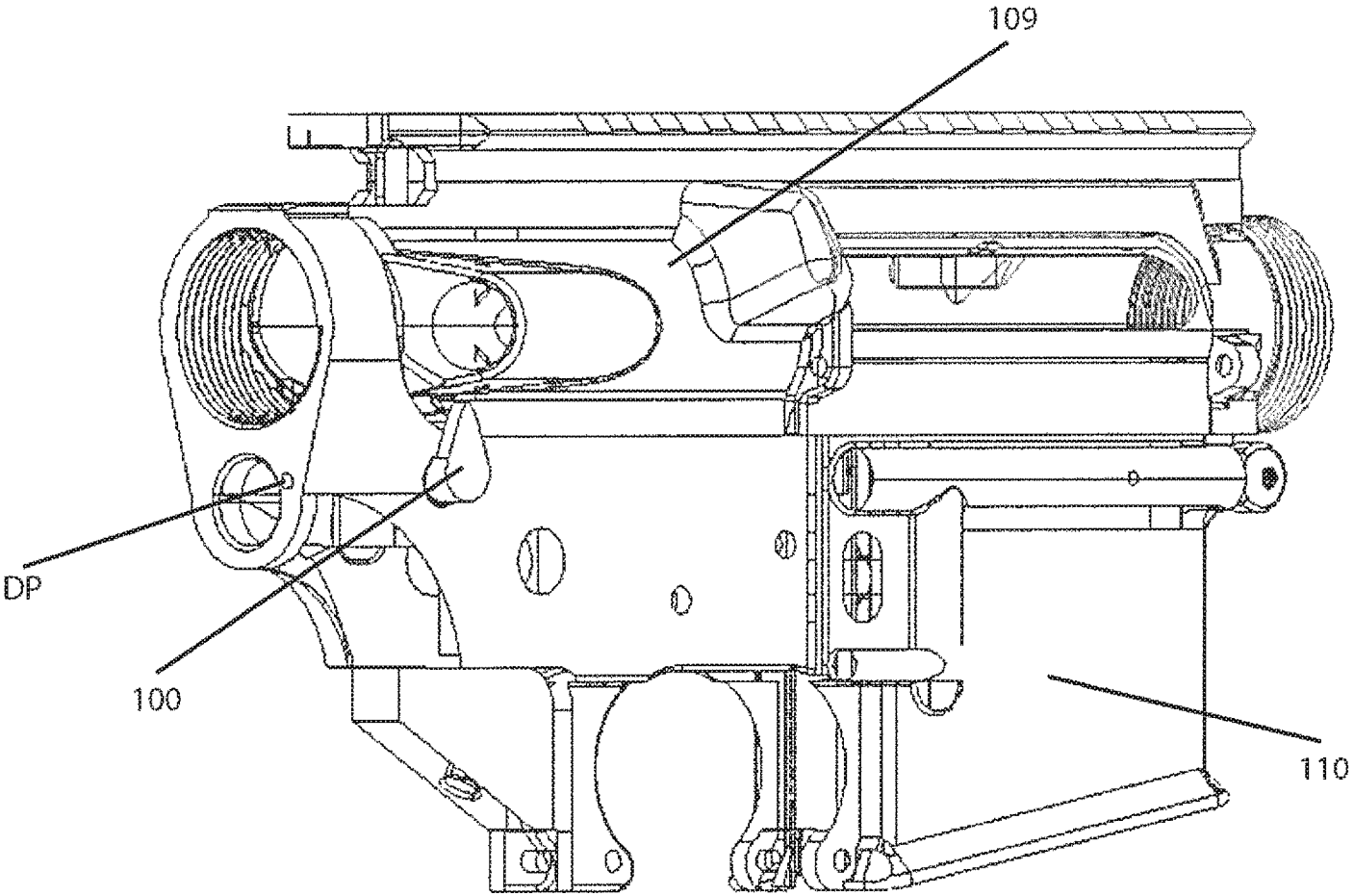
FIG. 5A is a rear right perspective view of the lower and upper receiver combination of FIG. 4A, wherein the takedown pin of FIG. 1A is still axially-engaged but has been rotated clockwise approximately 180 degrees from the secure position of the pin in FIGS. 4A and B, into the position/condition referred to herein as the "semi-secure" position.
Figure 5B:
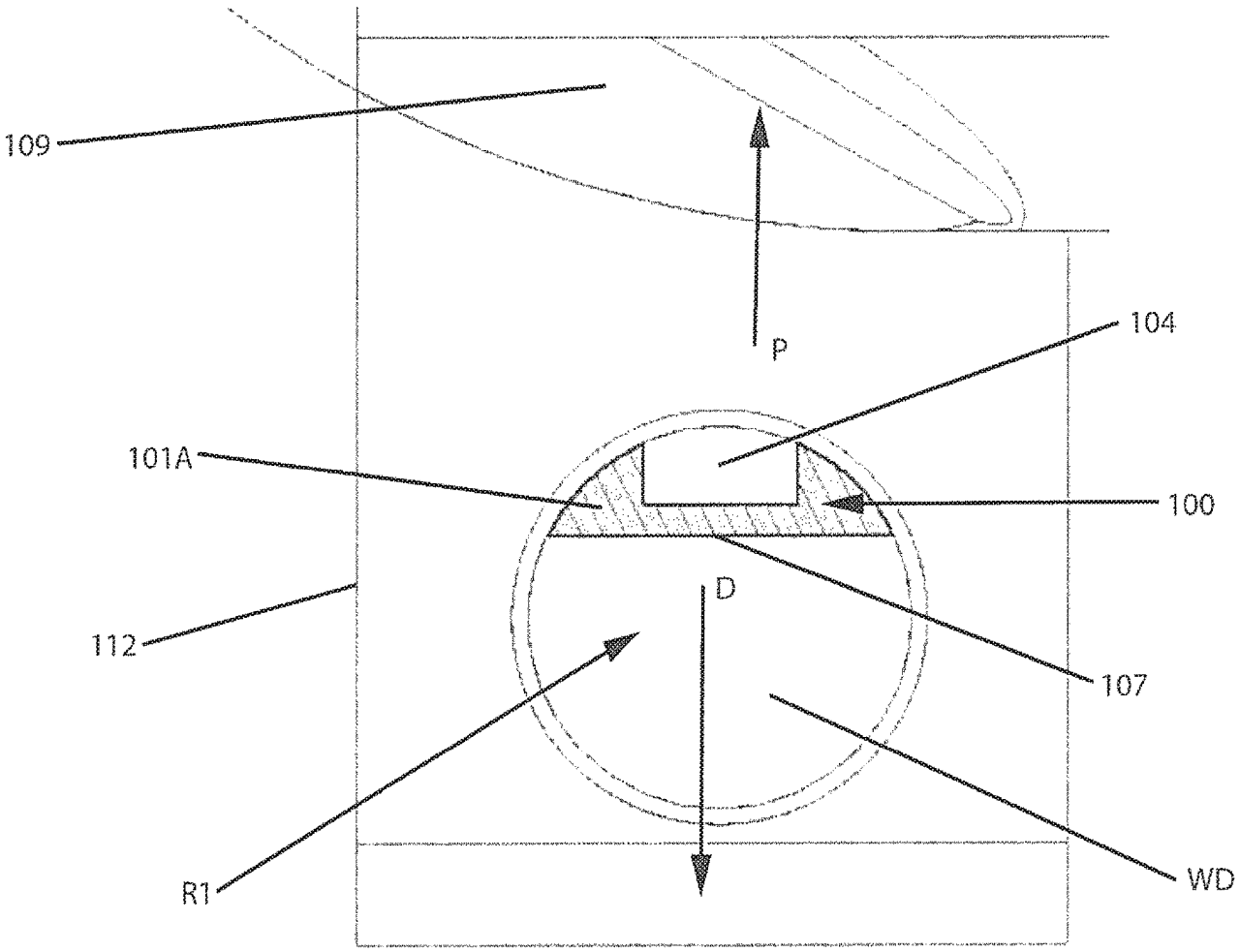
FIG. 5B is an enlarged right side detail view of the upper receiver of FIG. 5A and a cross-section of the pin of FIG. 1A (through the mid-section of the pin) in the semi-secured position of FIG. 5A but wherein the upper receiver has not yet pivoted relative to the pin, again without showing the lower receiver.

FIGS. 5A and B portray the takedown pin 100 repositioned into the semi-secure position from the secure position of FIGS. 4A and B, prior to pivoting of the upper receiver relative to the pin 100. In FIG. 5A, pin 100 has been rotated clockwise approximately 180 degrees from the secure position in FIGS. 4A and B, through the axially-engaged unsecure position, and into the semi-secure position. While in this semi-secure position, pin 100 may not be axially pulled or pushed, but very importantly, while in this position the rear knuckle 112 may pivot upward, and slide into the recess R1 to reach flange surface 107.

Figure 5C:
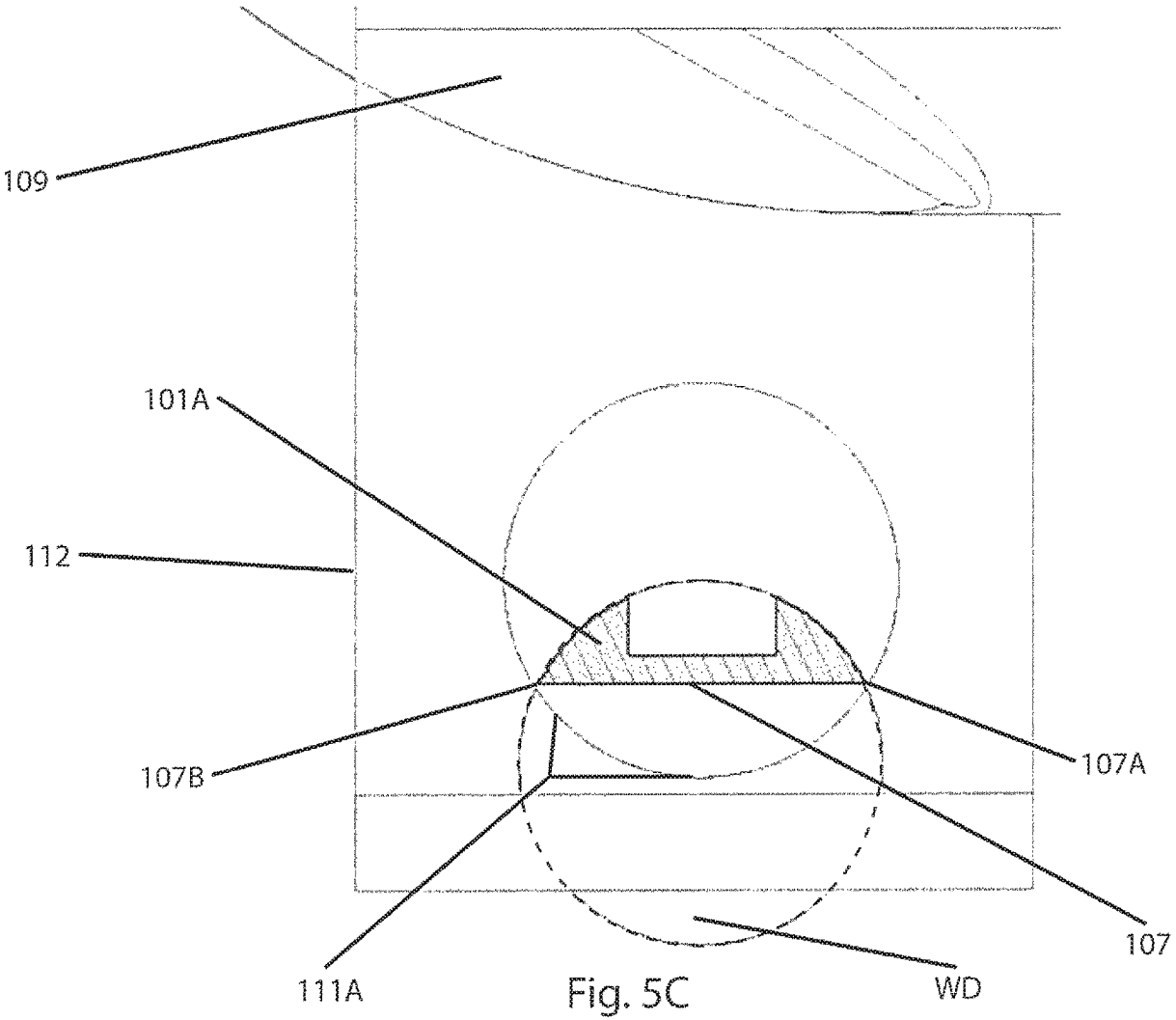
FIG. 5C is a right side view of the upper receiver and pin of FIG. 5B, again without showing the lower receiver, wherein the upper receiver has pivoted upward relative to the pin (and lower receiver), so that the upper and lower receivers are in the semi-secure, slightly-separated condition.

The pivoting of the upper receiver 109, relative to the pin 100 in the unsecured position, may occur due to gravity and is portrayed in FIG. 5C. In certain embodiments, assuming the firearm is being properly held by the operator in an upward and standard operating position, the weight of the upper receiver 109 plus the connected barrel (not shown, but well-known in this field) will typically have a center of gravity influenced by gravity to pivot the upper receiver 109 on the forward pivot hinge, thus causing the rear connection points of the lower and upper receivers to separate until the rear knuckle 112 is fully seated against the recessed flange surface 107, which in this embodiment means that the flange surface portions 107A, 107B contact respective portions of the lower surface 111A of hole 111. Of course, the operator may forcibly counteract the effect of gravity and self-control the separation of the rear connection points as well, but because gravity may aid in separating the rear connection points, it may also allow the operator to more freely use their hands for other critical tasks. Considering this, the ability of the takedown pin 100 to allow the rear connection points of the lower and upper receivers to separate in a limited and controlled manner, without the pin 100 having to be axially pulled and/or pushed, is a unique aspect and function compared to prior takedown pins. This may be appreciated by some operators who desire and/or require the breach of the firearm to be in an open position in-order to perform certain critical tasks, like (but not limited to) engaging and/or disengaging the magazine of a firearm.

In certain embodiments, this sliding into recess R1, as portrayed in FIG. 5C, may be described as involving a portion or portions of the inner surface of the hole 111 coupling with, contacting, and/or partially mating with surface 107. Thus, while in the semi-secure position, the takedown pin 100 may maintain axial engagement, while also allowing the receivers to separate in a limited and controlled manner at their rear connection points. The degree of separation between the lower and upper receivers may be determined by the depth of the recessed flange 107 and the amount/distance to which the rear knuckle 112 seats into the flange surface 107/recess R1. For example, the amount/distance to which the knuckle seats into the flange surface 107/recess R1 will at least in part be determined by the location of the surface 107, and the depth of the recess R1 that is preferably "deeper" than the radius of the main body 101 of the pin 100. For example, as illustrated in FIGS. 1C, 4B, and 5B, the recess R1 extends into the main body 101 of the pin 100 a distance D1 that is greater than the radius of the main body 101, As will be understood from FIGS. 5B and C, the deep recess R1 provides room for the rear knuckle 112 to "seat" into the flange surface 107/recess R1, by moving up into the recess R1 until portion(s) of the lower surface 111A contact the surface 107. Typically, for embodiments wherein surface 107 is planar and horizontal, the "seating" of the knuckle 112 relative to the surface 107 will be defined/limited by outer edges 107A and B of surface 107 reaching to and contacting the lower inner surface as shown in FIG. 5C. By comparing the pin 100 and knuckle 112 positions in FIGS. 5B and 5C, one may understand that the upper receiver has pivoted P upward relative to the pin in FIG. 5C, or, in other words, that the lower receiver has pivoted downward to pull the pin down relative to the upper receiver. As a result, the small/narrow region 101A of the pin is lower in the hole 111, to an extent that the edges 107A and 107B of the surface 107 are abutting against the lower inner surface 111A of the hole 111. This relative movement of pin (101A) and hole 111 has resulted in a lowering of the pin relative to the hole 111 a significant distance, that is, a distance sufficient to place the firearm in an inoperable mode.

Certain embodiments, using an unmodified rear knuckle and a reduced-dimension/diameter pin, may be described as allowing the upper receiver, in the semi-secure condition, to pivot the upper and lower receivers pivoting apart, on the front pivot pin axle of the receivers, an amount in the range of 0.1-2.0 degrees, or more typically for many conventional AR-15 upper and lower receivers, 0.8-1.2 degrees, or 1.0 degrees. For many AR-15 embodiments, pin 100 has a main body diameter (full-diameter portions WD & WP, which are typically the same) of approximately 0.25 inches, which is theoretically similar to the diameter of the takedown pin assembly hole 111 in the rear knuckle 112. Practically, the pin 100 would be machined with a high-side tolerance of said 0.25 inches, making the pin 100 close to, but not over, 0.25 inches in diameter (full diameter portions WD and WP). Further, the pin-receiving holes (of the lower and upper receivers) would be machined with a low-side tolerance of 0.25 inches, making the hole-diameter close to 0.25 inches, but no smaller. The machining tolerance would be approximately +/−1 to 2 thousandths of an inch, in certain embodiments. Considering the desirability of detent track/portions in certain embodiments, and the need to retain enough material to maintain stability/integrity/strength of the pin, an example of the recess R1 distance/depth D1 may be 0.175 inches (70% of pin full diameter) and an example of the corresponding maximum radial width RW1 may be about 0.075 inches (about 30% of pin diameter) or slightly less than 0.075 inches and 30% of the pin diameter when measured at the edge of the axial detent track as shown in FIGS. 1C and 3B. Such dimensions will allow the upper receiver to move/pivot upwards relative to the pin a distance in the range of 40-50 percent of the pin diameter, or, for many AR-15 embodiments, 45% of the pin diameter or 0.11 inches. Thus, given the design parameters of many AR-15 embodiments, the maximum separation of the upper and lower receivers at their rear connection points, with pin 100 in the semi-secure position in rear knuckle 112, corresponds to 1 degree of pivoting and a gap of approximately 0.11 inches of separation between the rear connection points.

Therefore, certain embodiments of the invention may be described as comprising: a takedown pin configured to have an enhanced detent track, which allows the pin to axially-engage and/or axially-disengage as well as to rotate when in an axially-engaged position. In addition, certain embodiments of the takedown pin are configured with a recessed side surface portion that allows the takedown pin to drop relative to the takedown assembly hole of the upper receiver, so that, in certain orientations of the pin (typically wherein the recessed side surface portion is horizontal and facing downward), the lower receiver in which the pin is captured may drop down slightly relative to the upper receiver rear knuckle and its hole. Or, in other words, said recessed side surface portion allows the upper receiver, in certain orientations of the pin (typically wherein the recessed side surface portion is horizontal and facing downward), to pivot upwards relative to the pin and hence the lower receiver, as said recess portion provides room in the hole to accommodate said upward pivoting. Furthermore, when the takedown pin is axially-engaged and the pin is in certain rotational position(s) (typically wherein the recess side surface portion is facing upward), the takedown pin keeps the upper receiver and lower receiver secure and thus also places the breach of the firearm in a closed and operable mode.

An alternative embodiment of the invented firearm takedown pin system comprises both a takedown pin that is specially-modified compared to prior art pins and an upper receiver that is specially-modified compared to prior art upper receivers. FIGS. 6A, 6B, & 6C, illustrate a takedown pin 200 embodiment that functions and cooperates with a novel and uniquely modified upper receiver 209. The combination and cooperation of the pin 200 and upper receiver 209, like the embodiments discussed above, provide a semi-secure position for the upper receiver relative to the lower receiver. This is accomplished, as in the embodiment's discussed above, by a reduced-diameter or otherwise-reduced region/portion of the pin allowing the upper receiver knuckle to slide/move relative to the pin when the pin is in certain orientation(s), thus allowing the receivers to pivot apart into a semi-secure position. In certain embodiments such as that in FIGS. 6A-C, the reduced-diameter/reduced-dimension region of the pin 200 is a narrow flange that preferably extends through the pin longitudinal axis in a radial direction, and that, in certain orientation(s) of the pin, slides into a recess/slot provided in the knuckle of the upper receiver 209.

Still referring to FIGS. 6A-C, one may see side views of the takedown pin 200. Some of the elements and aspects of the pin 200 include the mostly cylindrical main body 201, a positioning pin head end 202 with a protruding handle 202A, distal pin end 203 opposite the pin head end 202, and flange 213. The protruding handle 202A may act as both a tactile head designed to help the operator manually grip and manipulate the pin as well as a visual indicator helping depict what mode and/or position the takedown pin 200 is in. The flange 213 may be formed and/or defined by a preferably flat/planar, recessed, flange side 214 and a preferably flat/planar recessed, flange side 215 that is preferably bordered by a lip at one edge and so may be called a "lipped flange side". Flange sides 214 and 215 are preferably parallel to each other and recessed (or smaller in dimension/narrower) relative to the full diameter of the cylindrical main body 201 of the pin 200. This flange 213 is configured to fit into, and cooperate with, a recess/slot in the modified upper receiver 209, as will be further described below. The "lipped" flange side 215 is thus-described because a lip 215A may be provided along one edge of flange side 215, to enlarge that edge-end of the flange and/or otherwise provide a stop to prevent, when the pin 200 is in certain orientations, the flange 213 from sliding all the way through the recess/slot of the upper receiver, as will be discussed further below.

Note that in FIGS. 8B, 9B, and 10B and C, discussed below, the prior art lower receiver has been intentionally omitted to reveal and illustrate the relationship of the pin 200 with the takedown assembly hole of the rear knuckle.

As understood from the above disclosure, and understood by those familiar with conventional firearm receivers, the takedown pin 200 may be assembled to a prior art lower receiver, for example, lower receiver 110, in an axially fixed position using the conventional rear detent-spring and detent-pin system DP. It should be noted, that an additional benefit of takedown pin 200 being assembled in an axially-engaged (axially-fixed) position, is that the pin 200 may be installed with the positioning pin head end 202 on either the right-hand or left-hand side of the lower receiver 110, which may be a desirable feature for some operators. Certain embodiments of takedown pin 200 may be configured to rotate in a clockwise and/or counter-clockwise direction while fixed in the axially-engaged position, in-order to manually change the takedown pin 200 from the initial unsecure position, to either a secure and/or a semi-secure position. For example, pin 200 is rotated 90 degrees clockwise to move from the unsecure position in FIGS. 8A and B to the secure position in FIGS. 9A and B, and then another 90 degrees clockwise to move from the secure position to the semi-secure position of FIGS. 10A and B.

The detent track system may comprise one or two separate circumnavigating (circumferential) detent track sections, extending partially or completely around the circumference of the takedown pin. In pin 200, the first circumferential detent track section 205 is recessed and configured to partially circumnavigate around the mostly cylindrical main body 201 near the positioning pin head end 202, and the second circumferential detent track section 206 is recessed and configured to partially circumnavigate around the mostly cylindrical main body 201 near the distal end 203. Each circumferential detent track section may be designed to allow and guide the rotational movements of the takedown pin 200 in cooperation with the detent-spring and detent-pin system DP. Certain embodiments may have only one of the circumferential detent track sections at the proximal end of the takedown pin for insertion right-to-left in a conventional lower receiver that has a conventional detent-spring and detent-pin system DP in the right sidewall of the lower receiver. Certain embodiments may have only one of the circumferential detent track sections at the distal end of the takedown pin for insertion left-to-right in a lower receiver that has a conventional detent-spring and detent-pin system DP in the right sidewall of the lower receiver. Or, certain embodiments, such as takedown pin 200, may have both a proximal and a distal circumferential detent track/detent-track portion, for use in either or both right-to-left and left-to-right installation. Takedown pin 200 also comprises one or more detent dimples, for example, detent dimples 208A, B, and C and detent dimples 208D, E, and F, in the proximal and distal circumferential detent track sections 205, 206, respectively. Detent dimples 208A-C are recessed into the floor of the detent track section 205 to help, in a right-to-left installation, temporarily hold the takedown pin 200 in certain positions until enough force is applied by the operator to takedown pin 200 to dislodge the detent pin from an engaged detent dimple. Likewise, detent dimples 208D-F are recessed into the floor of the detent track section 206 to help, in a left-to-right installation, temporarily hold the takedown pin 200 in certain positions until enough force is applied by the operator to takedown pin 200 to dislodge the detent pin from an engaged detent dimple.

Pin 200 may also comprise a linear, axial detent track section connecting these circumnavigating detent track sections, but, as described below, the takedown pin 200 installed in certain receiver embodiments does not need to be axially pulled or pushed in-order to fully engage and/or fully disengage the rear connection points of the receivers, so a linear section of detent track is not necessary in all embodiments of a flanged takedown pin.

Figure 7:
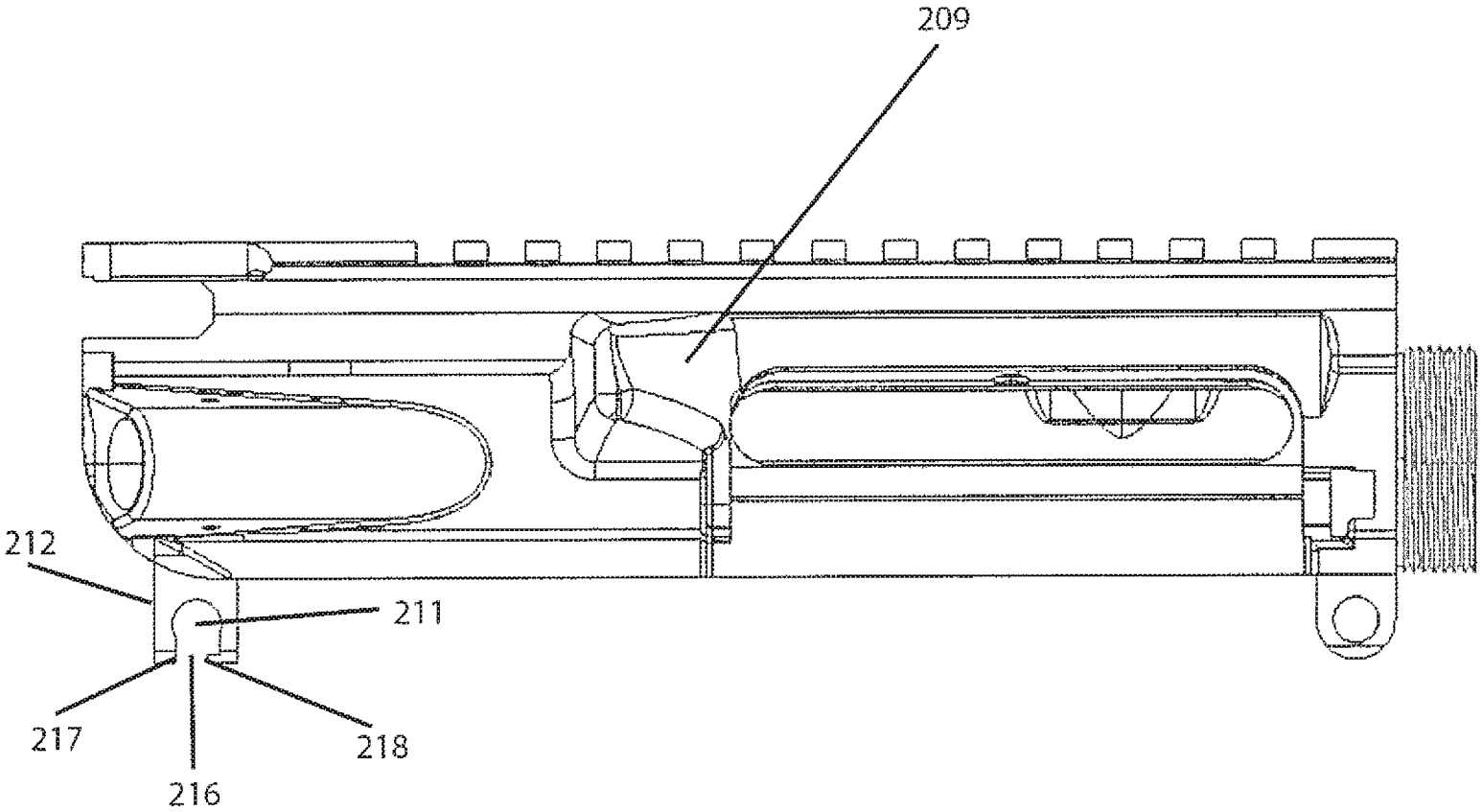
FIG. 7 is a right-side view of one embodiment of an invented upper receiver, which may share many aspects with a conventional upper receiver, but which has been modified to comprise an embodiment of a modified upper receiver rear knuckle.

Referring now to FIG. 7, is a right-side view illustrating one embodiment of the modified upper receiver 209 that shares many aspects with a prior art upper receiver, but that has been unconventionally designed with a modified rear knuckle 212. The modified rear knuckle 212 may comprise a cylindrically-shaped takedown assembly hole 211 uniquely designed with a slot 216 feature, which is formed/cut into and through the body of the modified rear knuckle 212. In addition, the slot 216 may be configured with a flat edge side 217 and a lipped edge side 218, which are configured to cooperate with the flange 213 of pin 200, and particularly with the lip 215A of the flange.

Note that alternatively-designed modified rear knuckles, that is, other than modified knuckle 212, are envisioned by the inventor, wherein the alternative modified knuckle(s) would each comprise a recess and/or slot designed to allow relative radial movement of a takedown pin in the hole of the knuckle. Such alternative modified knuckles would comprise a stop, recess floor, and/or other structure or modification that would prevent the takedown pin (including alternative takedown pins) from completely passing through the modified rear knuckle, but then it would be necessary for the alternative takedown pin to be axially-disengaged from the alternative modified rear knuckle in order to allow the rear connection points of the receivers to close, and also in order to allow the rear connection points of the receivers to disengage and fully separate (fully open).

Figure 8A:
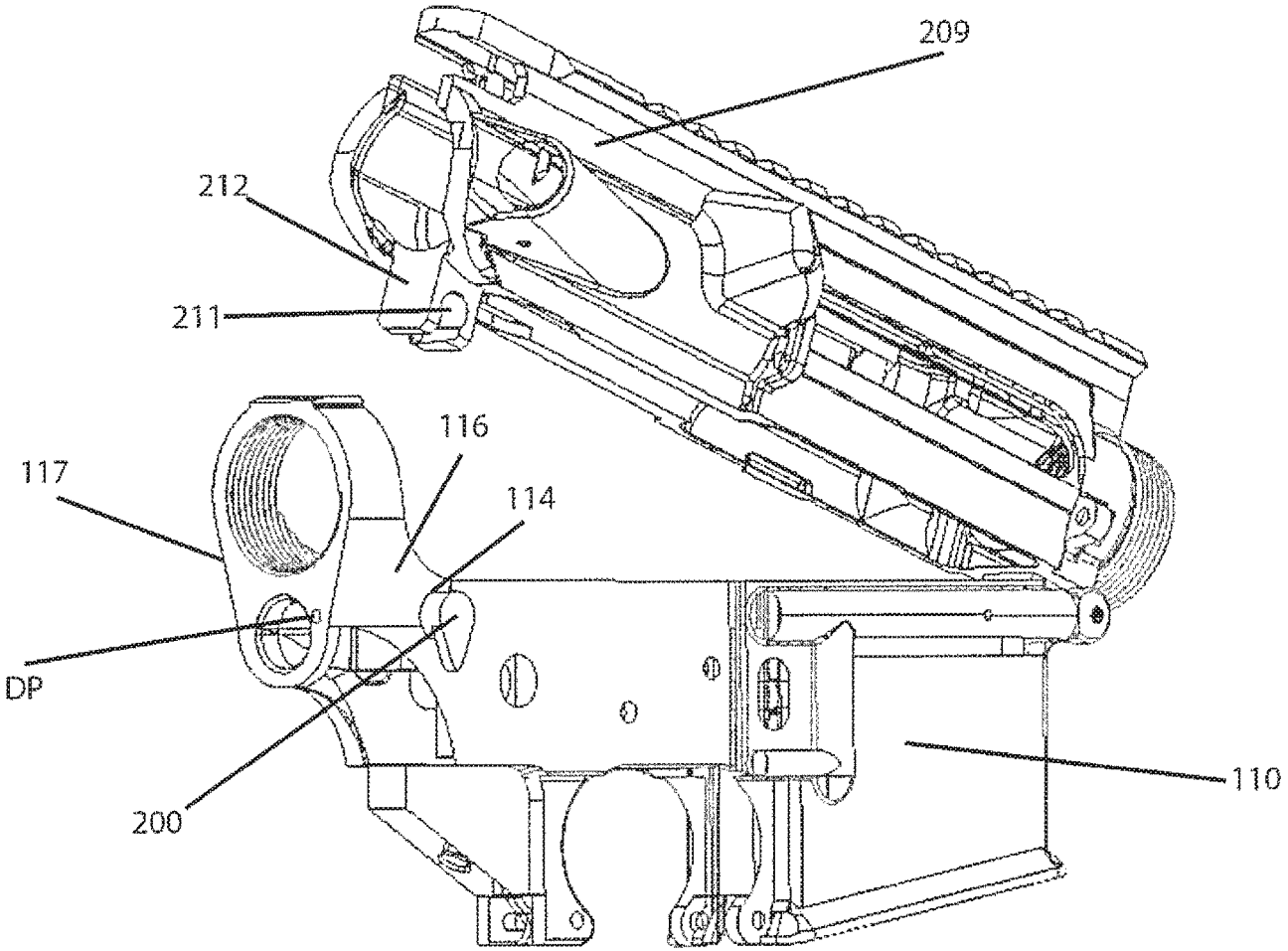
FIG. 8A is a rear right perspective view of a combination of a prior art lower receiver and the modified upper receiver of FIG. 7, shown pivoted apart to be fully separated (fully open) at their rear connection points, with the pin of FIG. 6A inserted into the lower receiver rear coupler in the unsecure position.

Referring now to FIG. 8A, a rear right side view illustrates takedown pin 200 temporarily held in the unsecure position. While in the unsecure position, the modified upper receiver 209 may pivot away from and fully separate (fully open) from the prior art lower receiver 110 at their rear connection points, because the pin 200 in the unsecure position fits entirely through the slot 216 in the rear knuckle. As depicted in FIG. 8A, when the receivers are fully separated, the modified rear knuckle 212 with modified takedown assembly hole 211 can be seen. In addition, while the rear connection points of the upper and lower receivers are fully separated, the internal bodies of the receivers and the assembly pieces housed within them may be accessed for maintenance and/or replacement. It may be noted that the handle 202A protrudes downward in this unsecure position for this pin embodiment, unlike the handle 102A rearward-protruding direction of FIG. 2. FIG. 8B is an enlarged detail cross-sectional view of takedown pin 200 in an unsecure position in the rear knuckle 212. The recessed flange side 214 of takedown pin 200 is facing toward the front of the firearm and the recessed, lipped flange side 215 is facing toward the rear of the firearm. The flange 213 has a maximum radial width RW2 (see FIGS. 6C and 10B) between flange side 214 and flange side 215 (which are preferably parallel), and is positioned on/in the pin 200, in such a way that the entire flange 213 including the flange lip 215A will fit through the slot 216 in the unsecure position.

Figure 8B:
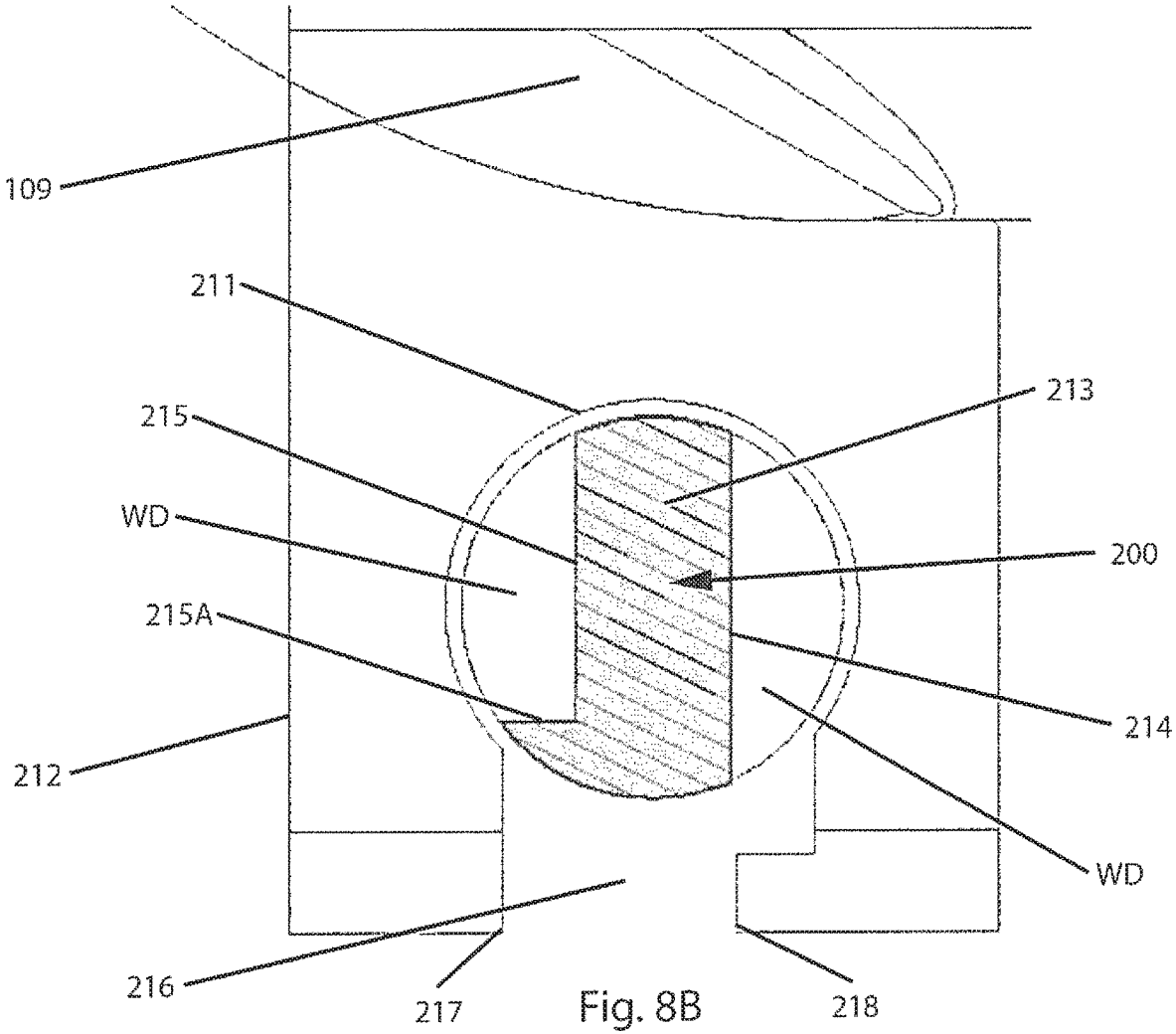
FIG. 8B is an enlarged right side detail view of the modified upper receiver of FIG. 8A and a cross-section of the pin of FIG. 6A (through the mid-section of the pin) in the unsecure position of FIG. 8A, again without showing the lower receiver. By viewing FIGS. 8A and B, one may understand that the upper and lower receivers of FIG. 6A may be closed, without removing/withdrawing the pin of FIG. 6A from its position in FIGS. 8A and B, due to its specially-modified structure.

As may be understood from FIG. 8B, slot 216 allows the protruding lip 215A to slide up or down past the flat side/edge 217 of the slot 216, and allows the flat flange surface 214 to slide up or down past the lipped side 218, thus allowing the upper receiver 209 to close against, or fully open from, the prior art lower receiver 110, when the pin 200 is in the unsecure position. Further, as may be understood from FIGS. 8B and 10B-D, the flange width RW2 plus the width of the transverse lip 215A is slightly less than the slot width SW. This way, in one orientation (FIG. 8B) the flange 213 and the lip 215A fit all the way through the slot 216, but in a different rotational orientation (FIGS. 10B-D) a portion of the flange may pass through the slot 216 but the lip 215A abuts against the bottom portion of the knuckle adjacent to the slot 216 and so is stopped/help-up inside the hole 211.

Figure 9A:
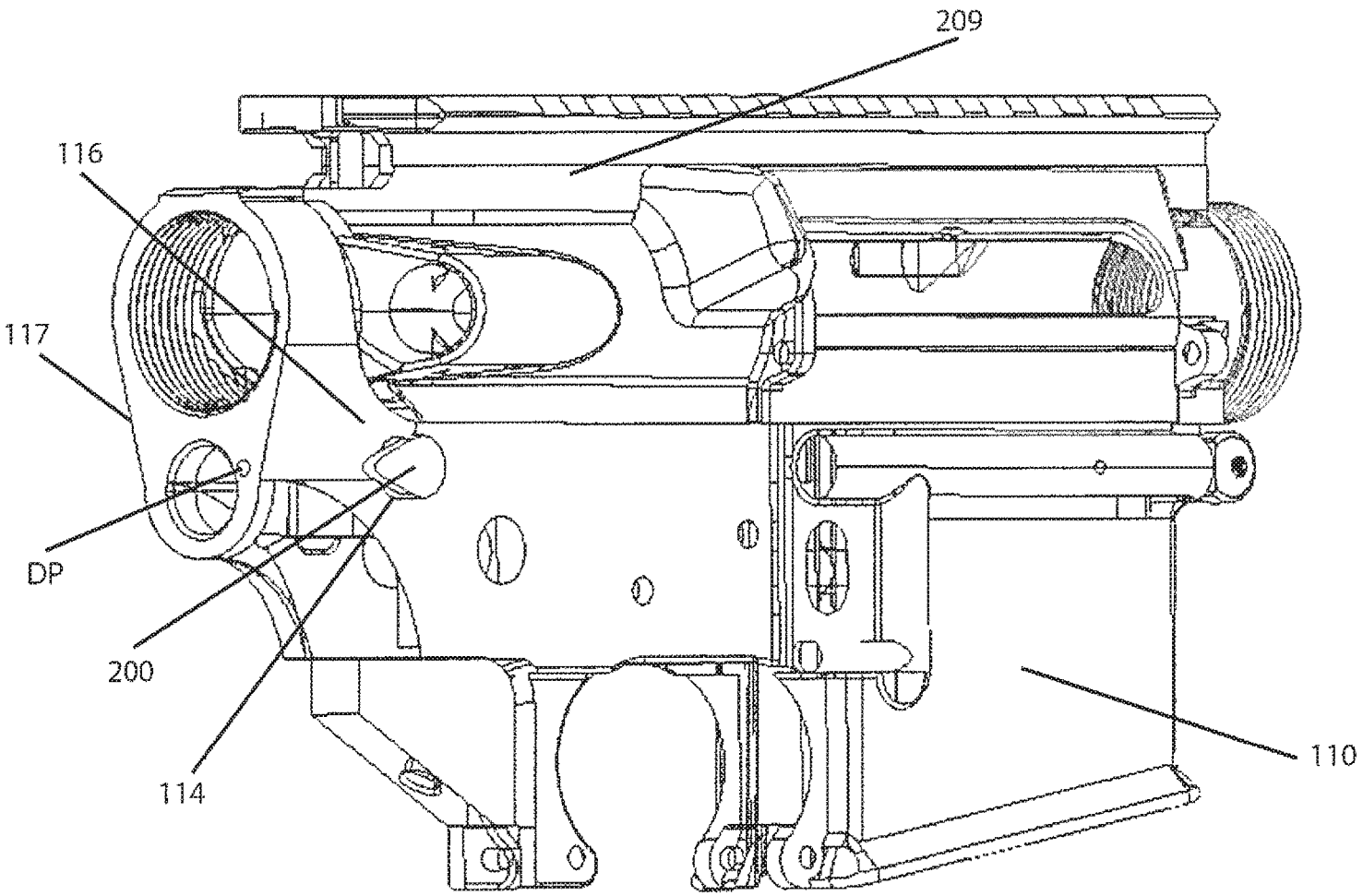
FIG. 9A is a rear right perspective view of the lower and upper receiver combination of FIG. 8A, with the takedown pin of FIG. 6A rotated clockwise approximately 90 degrees, from the pin position/condition in FIGS. 8A and 8B, into the secured position/condition.

FIG. 9A is a rear right perspective view illustrating the takedown pin 200 moved into the secure position. To get to this position from the unsecure position of FIGS. 8A and B, the upper receiver is closed against the lower receiver, as discussed in the paragraph immediately above, which means the modified rear knuckle 212 is lowered into and coupled within the rear coupler of the prior art lower receiver 110 and the upper receiver takedown assembly hole 211 is aligned with the rear coupler right and left takedown pin holes 114, 115 in the right sidewall 116 and left sidewall 117 (FIGS. 8A, 9A and 11) of the lower receiver, as will be understood by those familiar with such lower receivers. Then, the takedown pin 200 may be rotated clockwise approximately 90 degrees into the secure position shown in FIG. 9A. While in this secure position, the firearm may be considered to be in an operable and safe-to-discharge mode. It may be noted that the handle 202A protrudes rearward in this secure pin position, unlike the handle 102A downward-protruding direction in the secure position shown in FIG. 4A.

Figure 9B:
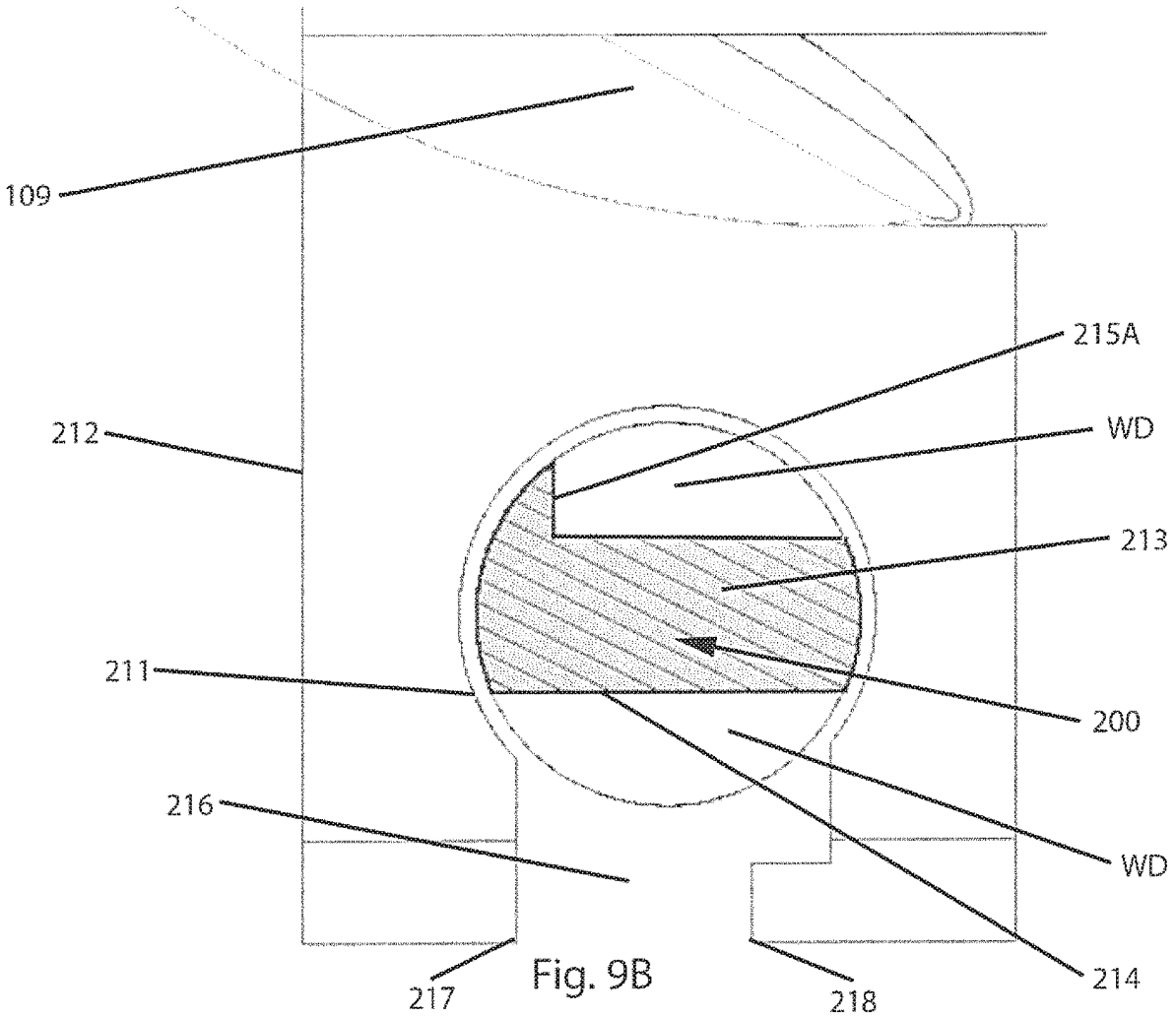
FIG. 9B is an enlarged right side detail view of the upper receiver of FIG. 9A and a cross-section of the pin of FIG. 6A (through the mid-section of the pin) as in the secured position in FIG. 9A, again without showing the lower receiver.

FIG. 9B is an enlarged detail view, with the pin cut in cross-section through the mid-section of the main body, showing the takedown pin 200 in the secure position. In this secure position, the flange 213 of takedown pin 200 snuggly spans most of the diameter of the takedown assembly hole 211, which temporarily secures the modified upper receiver 209 and the lower receiver 110 together at their rear connection points. This occurs because the pin 200 and the rear knuckle cannot move significantly up or down relative to each other due to the tight fit of the horizontal flange 213 in the hole 211. The gap shown between the right and left extremities of the horizontal flanged mid-section in FIG. 9B is schematic; in actual construction, the gap at said right and left flange extremities will be very small or almost non-existent, for example, so that the diameter of the pin at the flange fits snugly in the diameter of the hole 211 in FIG. 9B.

Figure 10A:
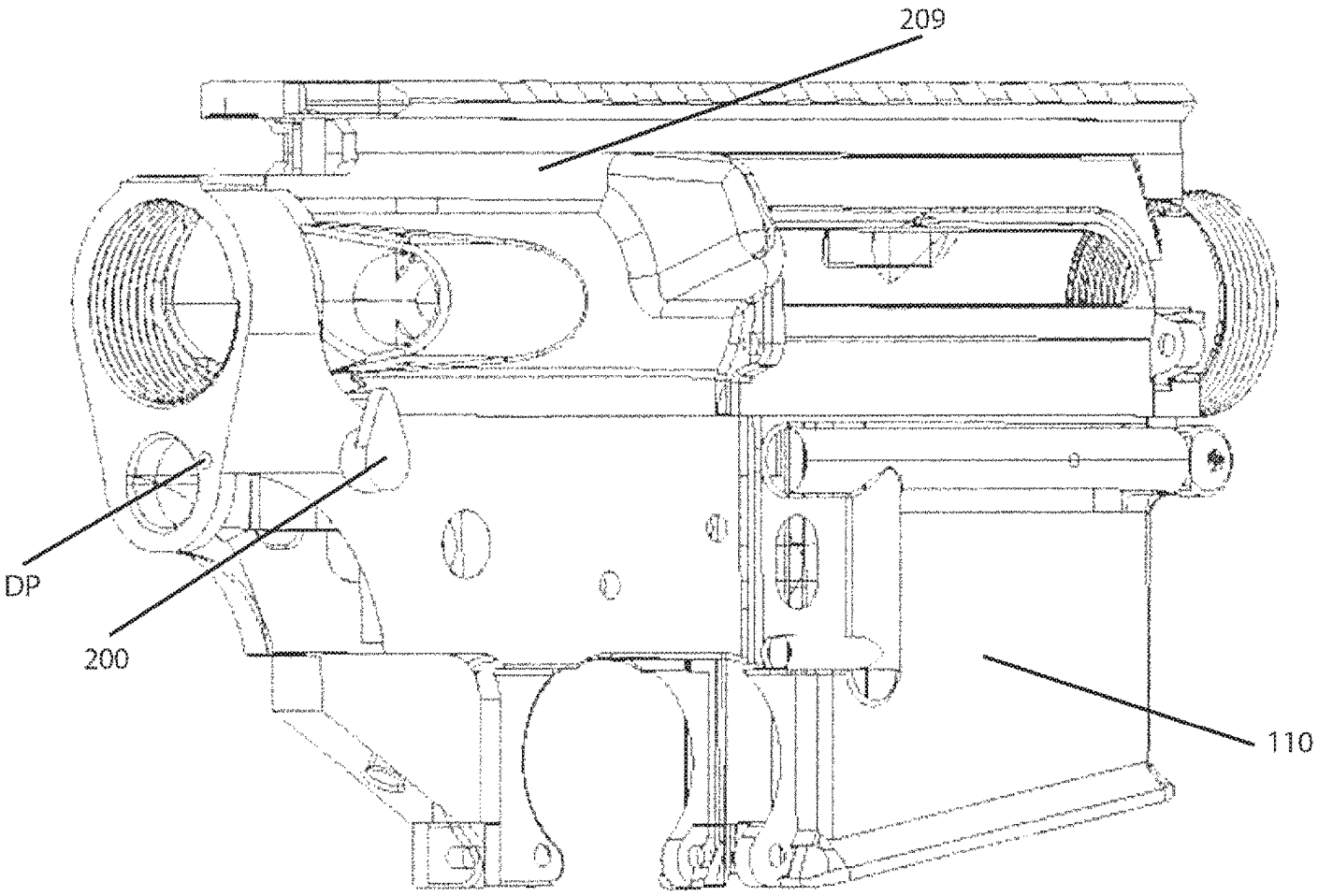
FIG. 10A is a rear right perspective view of the lower and upper receiver combination of FIG. 9A, which illustrates the takedown pin of FIG. 6A rotated clockwise approximately 90 degrees from the pin's secure position in FIGS. 9A and 9B, into the semi-secure position/condition.

FIG. 10A is a rear right perspective view that illustrates the takedown pin 200 in the semi-secure position. To get to this semi-secure position from the secure position of FIGS. 9A and B, the takedown pin 200 may be again rotated clockwise, approximately 90 degrees from its position in FIGS. 9A and B. While in this semi-secure position, the operator may allow the rear connection points to separate in a limited and controlled manner, which may be desired and/or necessary for some operators and/or firearm configurations.

Figure 10B:
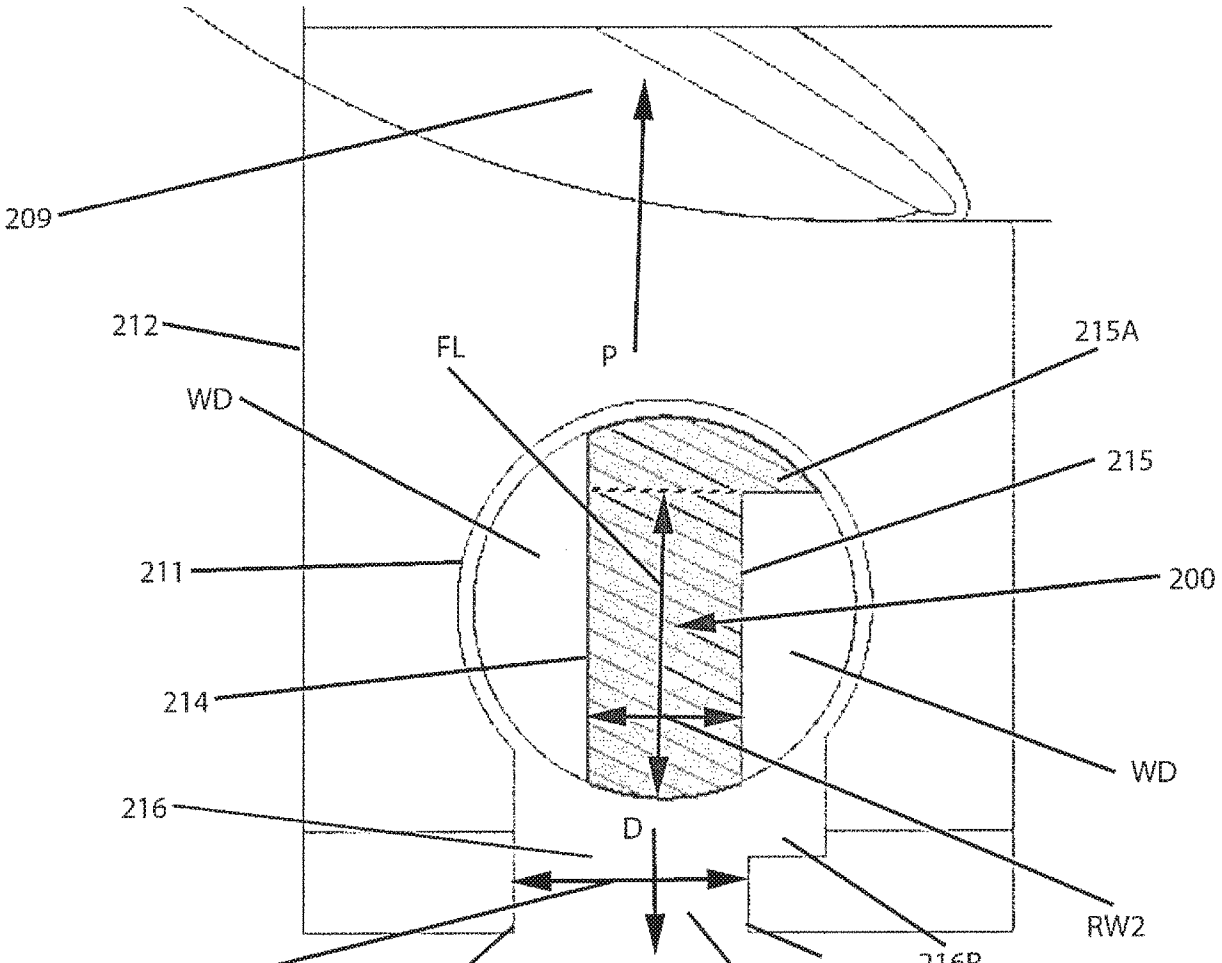
FIG. 10B is an enlarged right side detail view of the modified upper receiver of FIG. 10A and a cross-section of the pin of FIG. 6A (through the mid-section of the pin) as in the semi-secure position/condition of FIG. 10A, but wherein the upper receiver has not yet pivoted upward relative to the pin (and the lower receiver), and, for simplicity, without showing the lower receiver.
Figure 10C:
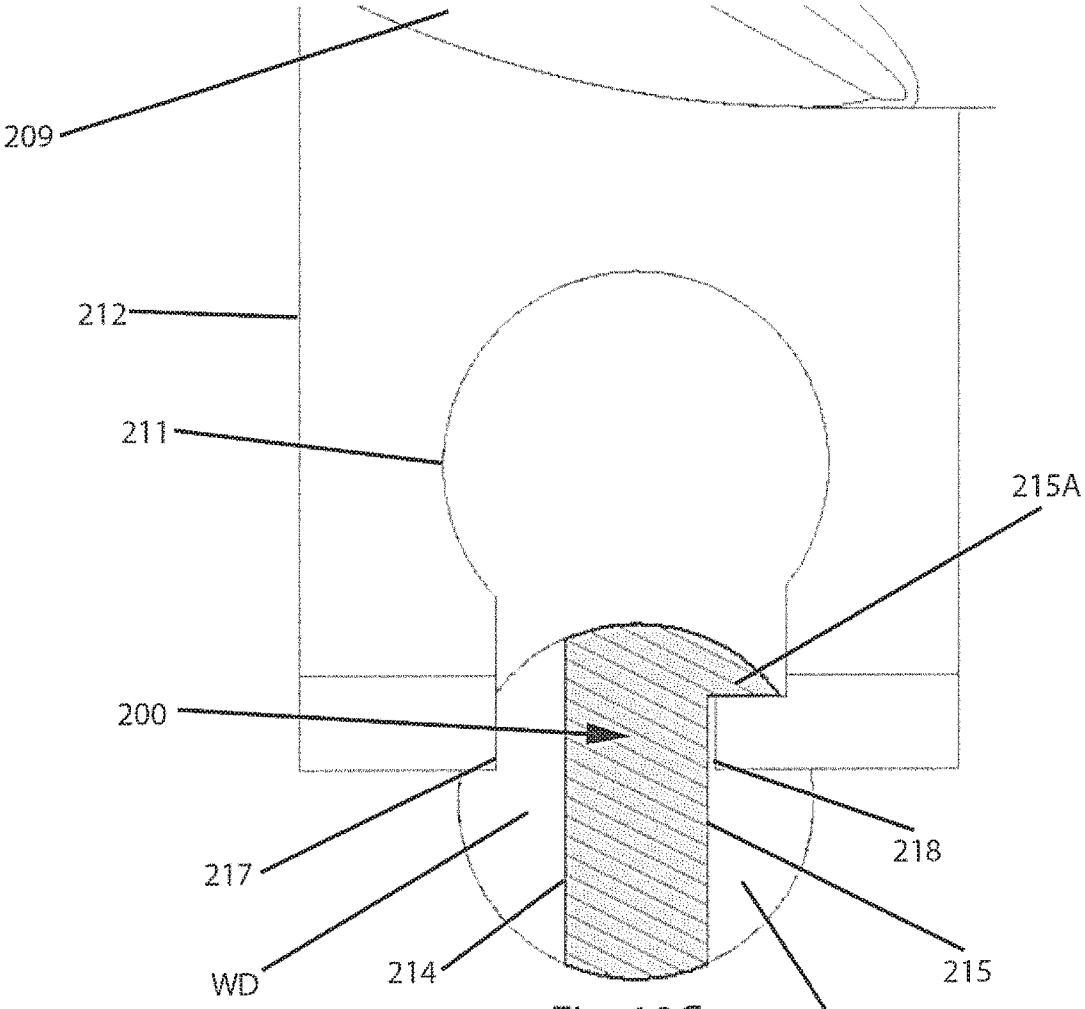
FIG. 10C is an enlarged right side detail view of the modified upper receiver and the pin of FIG. 10B, again not showing the lower receiver, wherein the upper receiver has pivoted upward relative to the pin (and the lower receiver), so that the upper and lower receivers are in the semi-secure, slightly-separated condition.
Figure 10D:
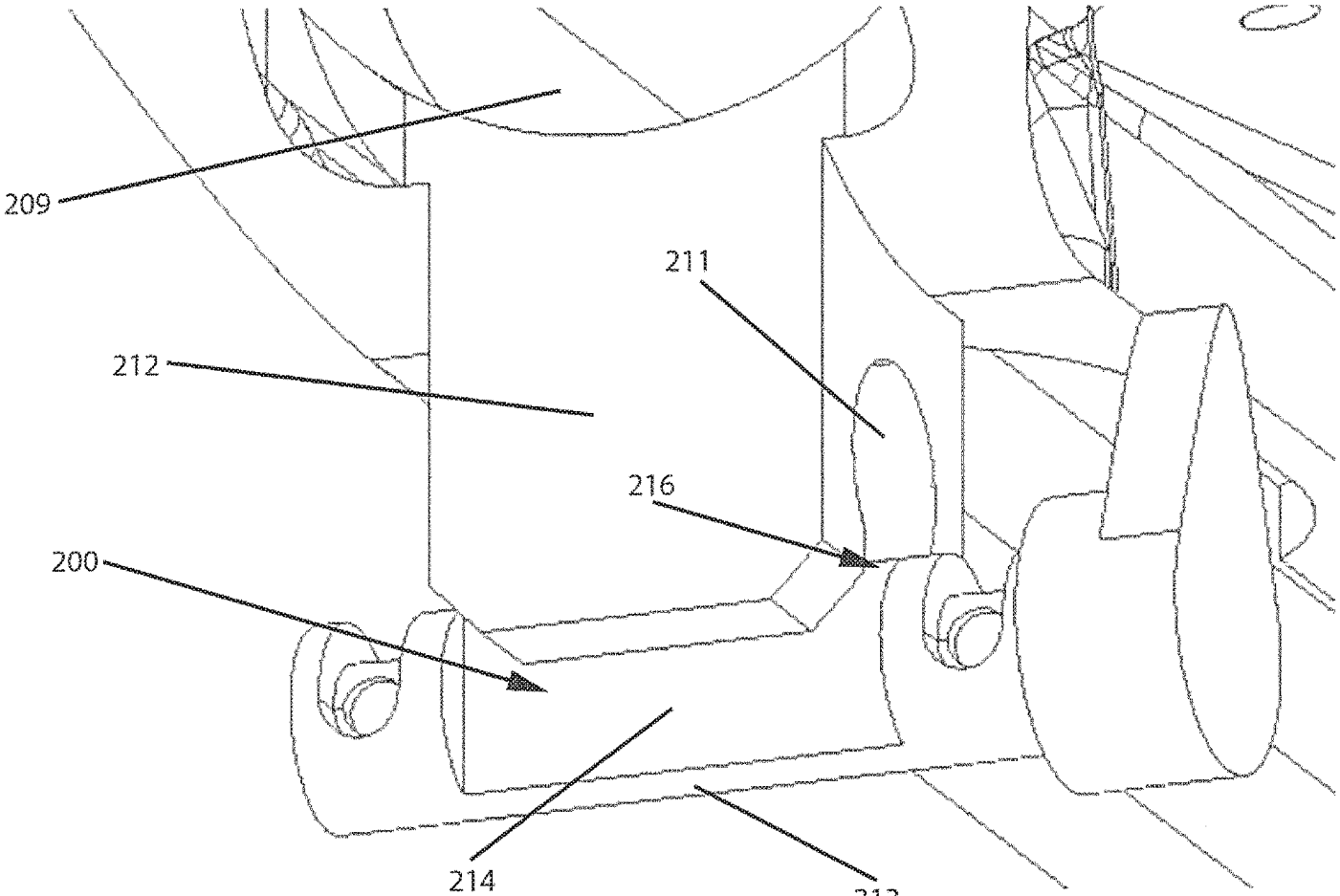
FIG. 10D is a rear right side perspective view of the upper receiver and pin of FIG. 10C in the semi-secured position of FIG. 10C.

FIG. 10B is an enlarged right side view, with the pin 200 shown in cross-sectional in the semi-secure position before the upper receiver has pivoted relative to the pin. While in this semi-secure position, the modified upper receiver 209 may separate from the exemplary lower receiver 110 at their rear connection points in a limited and controlled manner, because the flange 213 will slide through the slot 216 only to a limited and controlled extent, as shown in FIGS. 10C and D. This is because, similarly as described above for takedown pin 100, gravity typically will naturally pull down on and cause the modified upper receiver 209 to pivot on the forward pivot hinge, in this pin 200 and upper receiver 209 combination, causing the rear connection points to separate until the lipped side 218 of the modified rear knuckle 212 makes contact with and is stopped by the protruding flange lip 215A of the takedown pin 200. Considering this, the ability of takedown pin 200 to allow the rear connection points of the receivers to separate in a limited and controlled manner without the pin 200 having to be axially pulled and/or pushed is a unique aspect and function compared to prior takedown pins. This aspect/function may be beneficial and appreciated by some operators who desire and/or require the breach of the firearm to be in an open position in-order to perform certain critical tasks, like (but not limited to) engaging and/or disengaging the magazine of a firearm. It should be noted that, while both the pin 100 and pin 200 configurations/systems described above allow the rear connection points of the receivers to open in a limited and controlled manner while in their semi-secure positions, the combination of takedown pin 200 and modified upper receiver 209 may allow a greater degree/amount of separation due to the slot 216 though the rear knuckle, which may be more beneficial for some operators and/or firearm configurations.

Certain embodiments using a modified rear knuckle may be described as allowing the upper receiver, in the semi-secure condition, to pivot the upper and lower receivers apart, on the front pivot pin axle of the receivers, an amount in the range of 1.5-3 degrees, or, more typically for many AR-15 lower receivers and modified upper receivers, 2.0-2.6 degrees, or 2.3 degrees. Similar to pin 100, the main body diameter (of WP and WD) of pin 200 for many AR-15 embodiments is approximately 0.25 inches, which is theoretically similar to the diameter of hole 211 in the rear knuckle 212. Practically, the pin 200 would be machined with a high-side tolerance of said 0.25 inches, making the pin close to, but not over 0.25 inches, and, as discussed above, the receiver assembly holes would be machined with a low-side tolerance of 0.25 inches, making the hole diameter close to 0.25 inches, but no smaller. The tolerance would be approximately +/−1 to 2 thousandths of an inch, in certain embodiments. Flange width RW2 may be 0.1 inches, which is approximately 40 percent of the pin's full diameter. Lip 215A may extend about 0.05 inches transversely from flange surface 215, or about 20 percent of the pin's full diameter. Given these parameters, slot 216 of the rear knuckle 112 will be fractionally greater than 60% of the diameter of the assembly hole, or fractionally greater than 0.15 inches. The flange length FL (FIG. 10B) is about 70-80% of the full pin diameter, and the pin midsection typically may slide fully into/through the slot 216, including the recess portion 216R (FIG. 10C). Such dimensions allow the upper receiver move/pivot upwards relative to the pin a distance in the range of about 100-120 percent of the pin diameter (FIGS. 10C and D), or, for many AR-15 embodiments, 0.25-0.3 inches. Thus, given the design parameters of many AR-1.5 embodiments, the maximum separation of the upper and lower receivers at their rear connections points, with pin 200 in the semi-secure position, the rear knuckle 212 may pivot open 2.3 degrees, providing a gap of 0.25-0.3 inches separation of the upper and lower receivers at their rear connection points.

Figure 11:
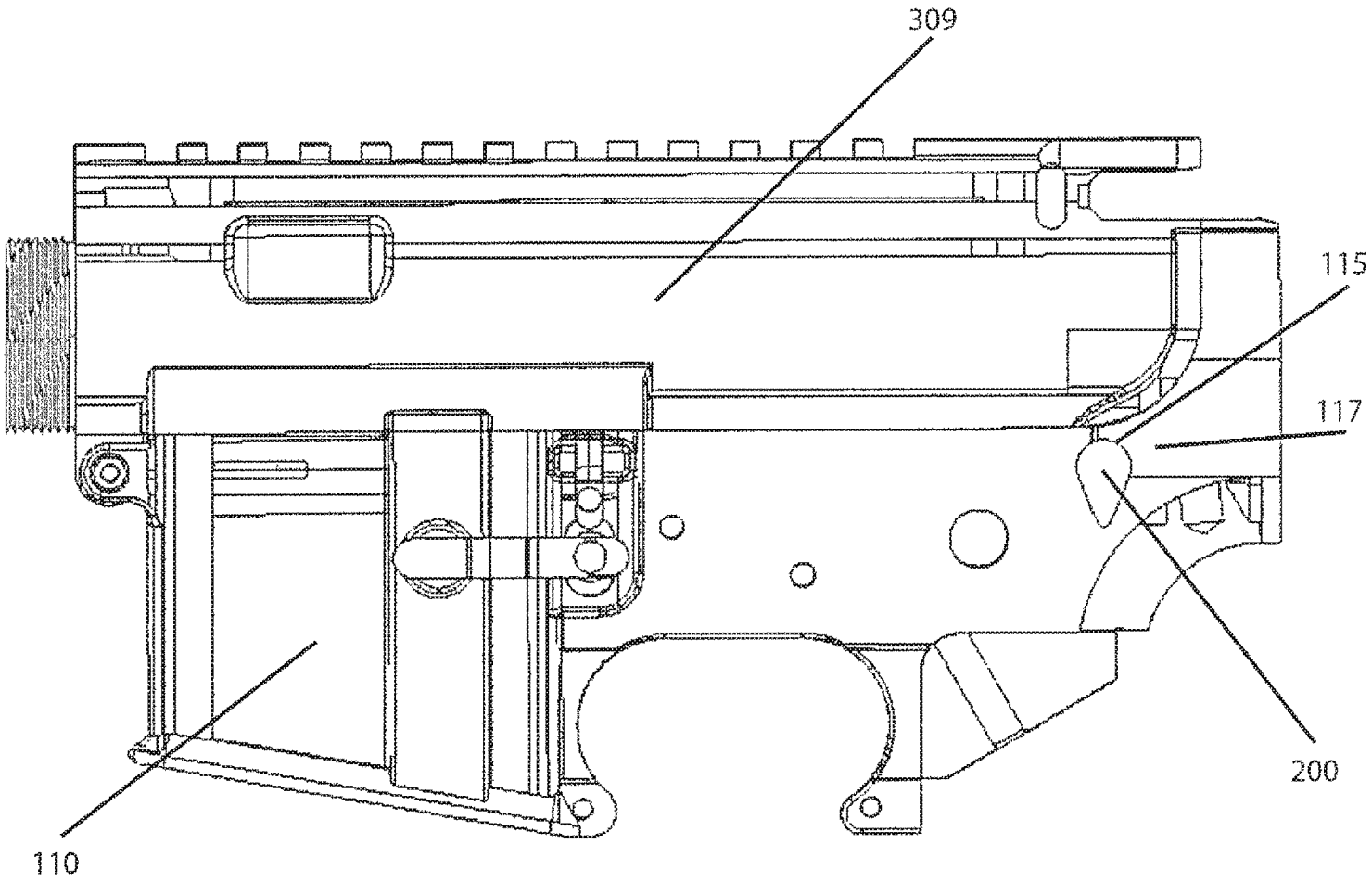
FIG. 11 is a left side view, which illustrates the pin of FIG. 6A placed into the unsecure position by inserting the pin from left to right into another embodiment of a combination of a prior art lower receiver and a specially-modified upper receiver.

Referring to FIG. 11, as mentioned above, it may also be possible for takedown pin 200 to be installed to the exemplary prior art lower receiver 110 so that the positioning pin head end 202 is placed onto the un-conventional left-hand side of the conventional lower receiver 110. Modified upper receiver 309 utilized for this exemplary left-hand configuration and its relationship with the takedown pin 200, are detailed in FIGS. 12 and 13A-C. Many of the features and functionality that apply to this left-handed configuration have already been described above in relation to a right-side pin-insertion, as will be understood from this document and the drawings.

Figure 12:
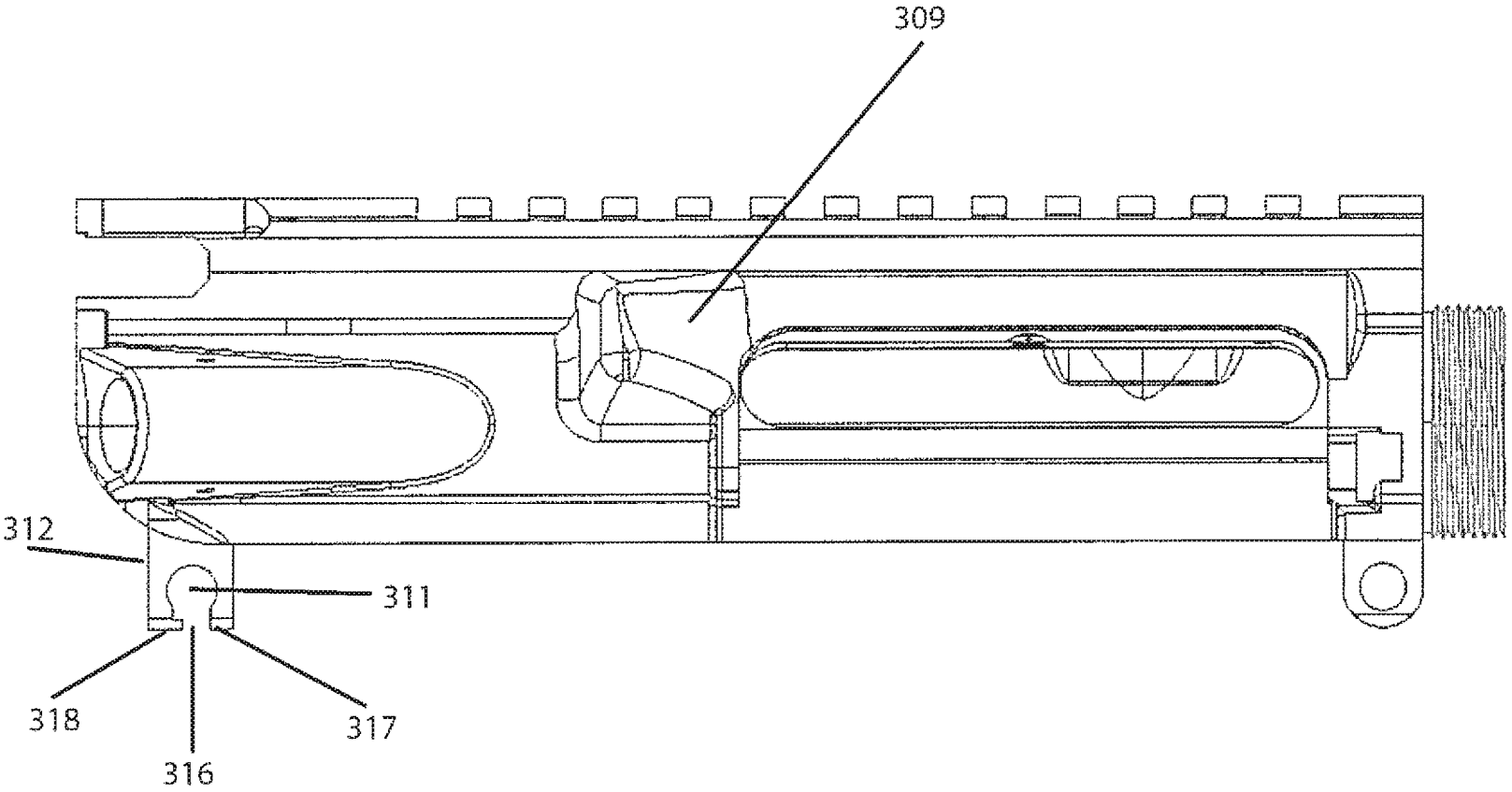
FIG. 12 is a right side view of the modified upper receiver of FIG. 11, illustrating another embodiment of a rear knuckle comprising a slot.

FIG. 12 is a right side view that depicts the modified upper receiver 309, which comprises a modified rear knuckle 312 including modified takedown assembly hole 311. Similar to modified upper receiver 209 of FIG. 7, one may notice that the orientation of the flat edge 317 and the lipped edge 318 of the slot 316 have been switched so that the lipped edge 318 is now on the rear side of the slot 316. This alternative configuration allows modified upper receiver 309 to function with the now-left-hand-installed takedown pin 200 so that the pin 200 may be rotated into the secure, semi-secure, and unsecure positions.

Figure 13A:
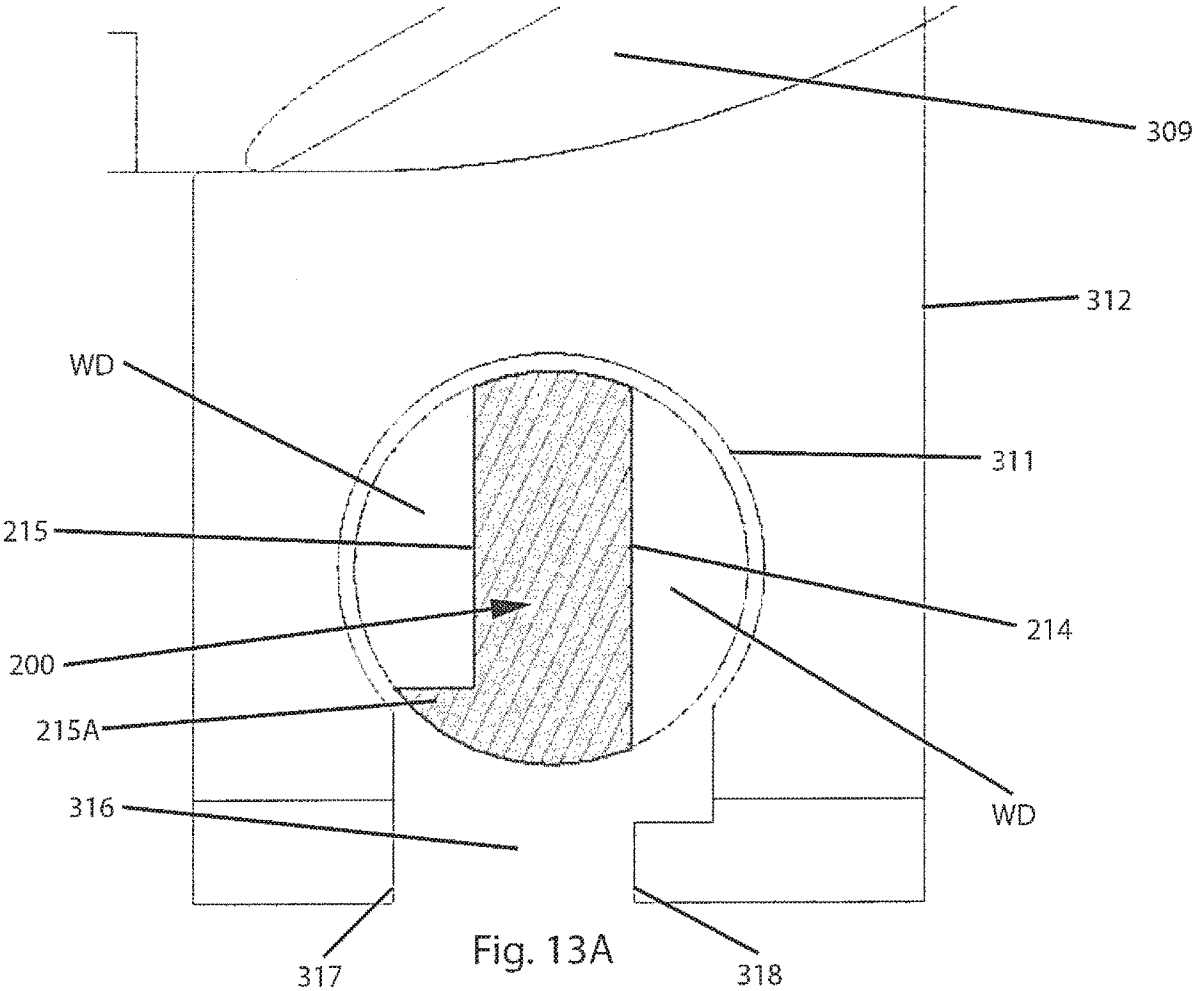
FIG. 13A is an enlarged left side detail view of the modified upper receiver of FIG. 12, plus a cross-sectional view of the takedown pin of FIG. 6A (through the mid-section of the pin) in the unsecure position as in FIG. 11, but, for simplicity, without showing the lower receiver.
Figure 13B:
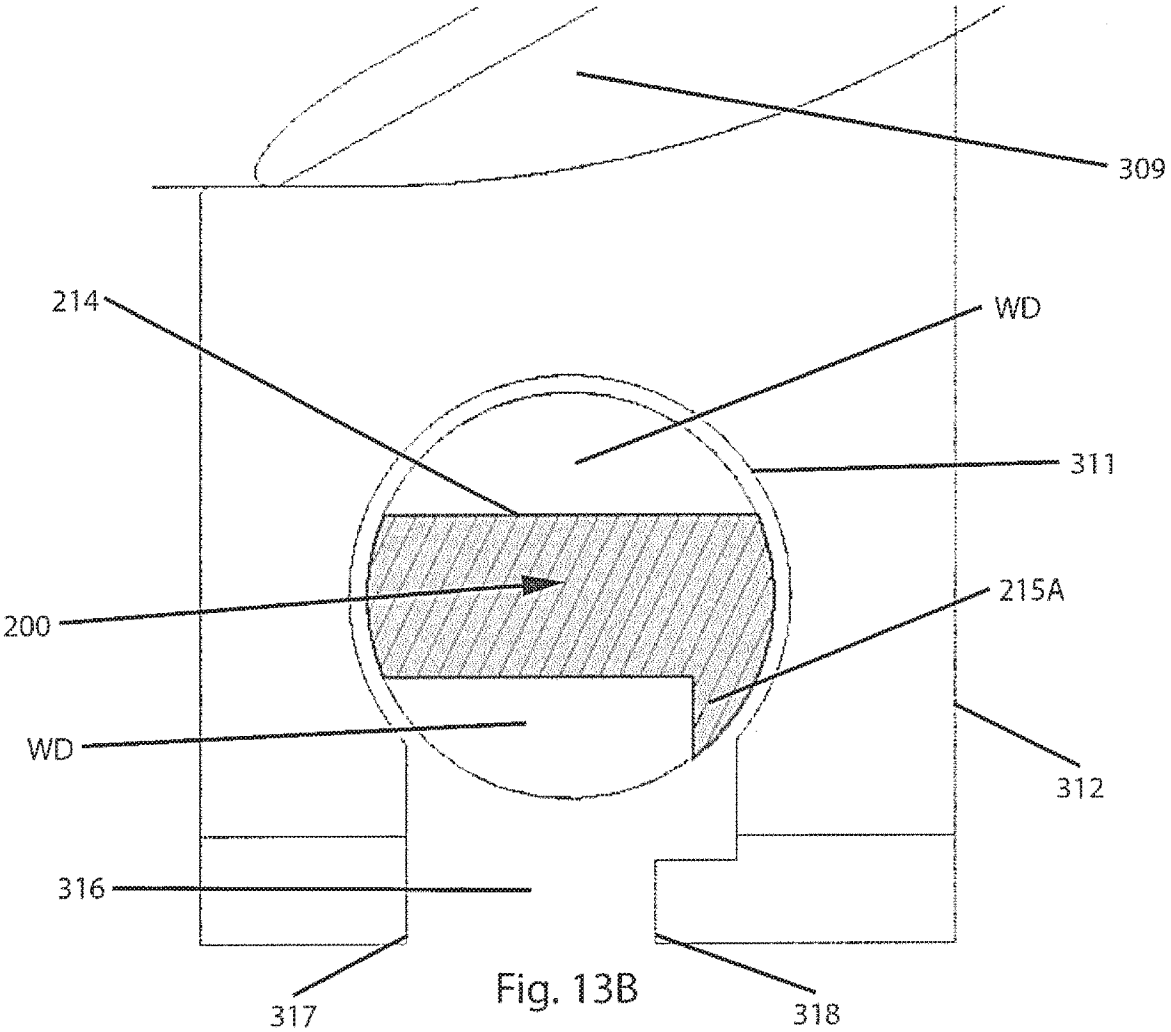
FIG. 13B is a left side view of the modified upper receiver and pin of FIG. 13A, wherein the pin has been placed into the secure position by counter-clockwise rotation of the pin about 90 degrees from the pin's unsecure position in FIG. 13A.
Figure 13C:
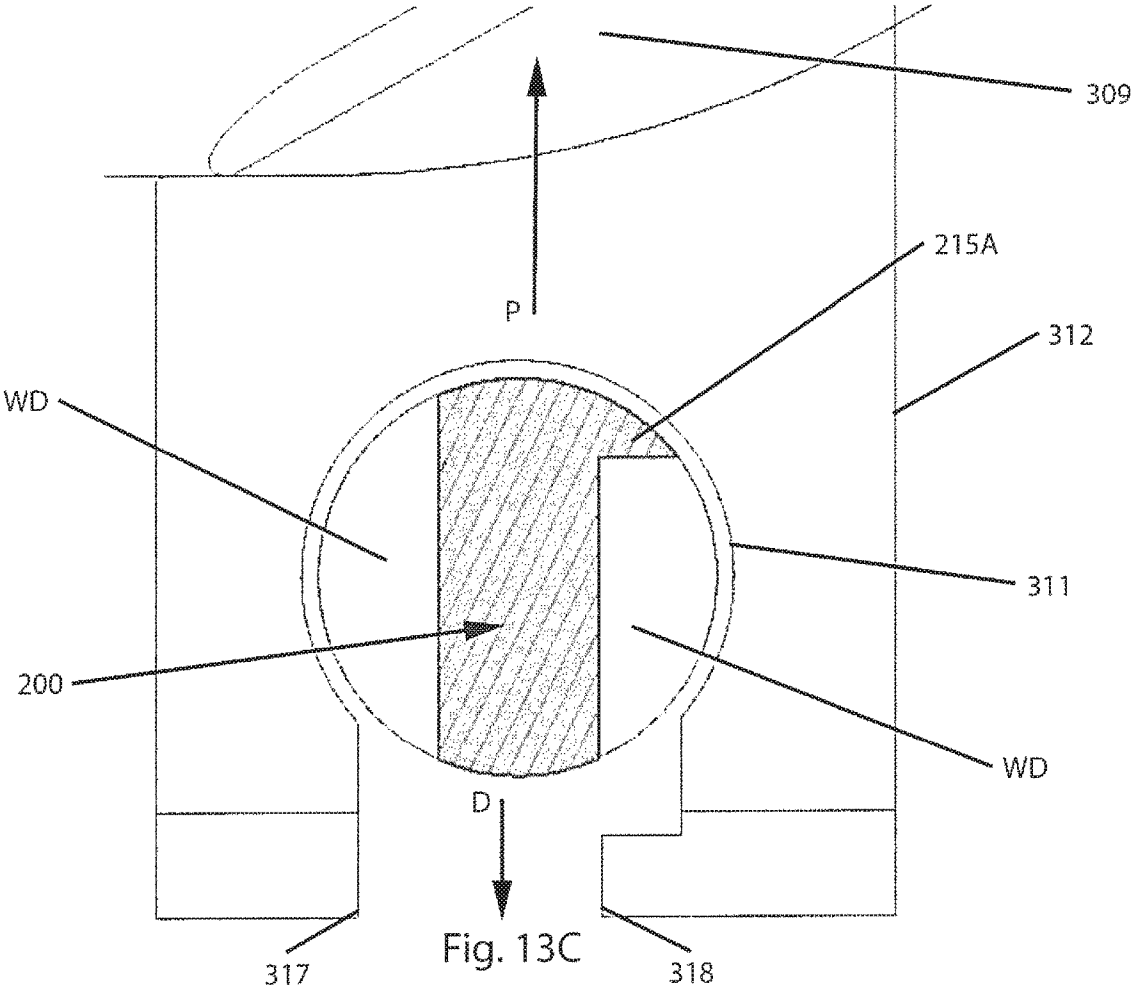
FIG. 13C is a left side view of the modified upper receiver and pin of FIG. 13B, wherein the pin has been placed into the semi-secure position by counter-clockwise rotation of the pin about 90 degrees from the pin's secure position in FIG. 13B.

Again, the exemplary prior art lower receiver 110 has been intentionally omitted from FIGS. 13A, 13B, and 13C to help reveal the relationship of takedown pin 200 to the modified rear knuckle 312.

FIG. 13A is an enlarged detail side view of the rear of the upper receiver plus a radial cross-sectional view, of the pin 200 in the unsecure position, taken at the flanged mid-section of takedown pin 200. Similar to the previously described configuration, while in the unsecure position, the rear connection points of the lower and upper receivers may be fully disengaged and separated, because the slot 316 in the rear knuckle 312 will "clear" the narrow flange 213 of the pin 200, by sliding down past flange side 214, and also flange side 215 including protruding lip 215A.

FIG. 13B shows the detail of FIG. 13A, with pin 200 having been rotated approximately 90 degrees in a counter-clockwise direction, from the unsecure position of FIG. 13A, to be positioned in this secure position.

FIG. 13C shows the detail of FIGS. 13A and B, but with takedown pin 200 now in the semi-secure position. Takedown pin 200 in FIG. 13C has been rotated approximately another 90 degrees in the counter-clockwise direction, from the secure position of FIG. 13B, to be positioned into the semi-secure position. With the pin 200 in this position, the upper receiver 309 may pivot a limited and controlled amount upward away from the pin 200 and the lower receiver. The relative movement, allowed by the pin orientation in FIG. 13C, is indicated by the pivot arrow P for the upper receiver and the downward arrow D for pin 200. This relative movement results in the pin dropping down into the slot of the rear knuckle 312, similarly as portrayed for pin 200 and rear knuckle 212 in FIG. 10C.

Therefore, certain embodiments of the invention may comprise: a takedown pin configured to have an enhanced detent track, which allows the pin to axially-engage (and optionally to be held in an axially-disengaged position) by a detent pin system, as well as to rotate when in the axially-engaged position. In addition, certain embodiments of the takedown pin are configured with a flange, which is designed to drop-into/couple-with a slot in the takedown assembly hole region of the upper receiver when the pin is properly aligned with said slot. Furthermore, when the takedown pin is axially-engaged and rotationally positioned so that the flange is transverse to the slot of the upper receiver, the assembly of the takedown pin, upper receiver, and lower receiver are secure and the breach of the firearm is in a closed and operable mode.

Certain embodiments may be described as: a firearm takedown pin receiver-connection system comprising: a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together; the system further comprising a takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position. The maximum radial width may be 25% to 35% of the proximal portion diameter and of the distal portion diameter, for example. The recess may have a depth equal to 65-75 percent of the proximal pin end portion, and the recess may face down in the takedown pin hole when the takedown pin is in the semi-secure position. Said at least one axial side surface may have a recess comprising a recessed surface that is cut into the midsection so that the maximum radial width is less than half of the proximal portion diameter and less than half of the distal portion diameter. In certain embodiments, the rear knuckle has a slot through a bottom portion of the rear knuckle, the slot having a slot width, and wherein said at least one axial side surface having a recess comprising a first flange surface in the midsection on a first axial side of the midsection, and a second flange surface in the midsection on an opposing second axial side of the midsection, wherein the first and second flange surfaces are parallel to each other and form a flange having a radial width that is said maximum radial width and that is smaller than the slot width, so that when the takedown pin is rotated to said semi-secure pin position, the rear knuckle slides upward relative to the takedown pin midsection so that the flange is received in the slot and the upper receiver pivots upward to said semi-secure upper receiver position. The radial width of the flange may be 35-45% of the proximal portion diameter and of the distal portion diameter. A first slot edge and a second slot edge of the bottom portion of the rear knuckle may define said slot, and the midsection further may comprise a lip that protrudes from the first flange surface, the lip being transverse to the first flange surface and the lip being adapted to abutt against said first slot edge when the pin is in the semi-secure position to prevent the takedown pin from entirely sliding out of the rear knuckle. In certain embodiments, the lower receiver further comprises a detent pin system, and the proximal end portion of the takedown pin comprises a first circumferential detent track portion having a plurality of detent dimples, so that the detent pin system cooperates with the circumferential detent track portion and said detent dimples during rotation of the takedown pin. The distal end portion of the takedown pin may comprise a second circumferential detent track portion having a plurality of detent dimples. In certain embodiments having the circumferential track portion(s), the takedown pin is rotatable to place the lower and upper receivers in all of a unsecure condition, secure condition, and said semi-secure condition, without moving the takedown pin axially.

Certain embodiments may be described as: a firearm takedown pin for connection of a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together; the takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position. The maximum radial width may be 25% to 35% of the proximal portion diameter and of the distal portion diameter, for example. The recess may have a depth equal to 65-75 percent of the proximal pin end portion, and the recess may face down in the takedown pin hole when the takedown pin is in the semi-secure position. Said at least one axial side surface may have a recess comprising a recessed surface that is cut into the midsection so that the maximum radial width is less than half of the proximal portion diameter and less than half of the distal portion diameter. Said at least one axial side surface may have a recess comprising a first flange surface in the midsection on a first axial side of the midsection, and a second flange surface in the midsection on an opposing second axial side of the midsection, wherein the first and second flange surfaces are parallel to each other and form a flange having a radial width that is said maximum radial width and that is smaller than the slot width, so that when the takedown pin is rotated to said semi-secure pin position, the rear knuckle slides upward relative to the takedown pin midsection so that the flange is received in a slot through a bottom portion of the rear knuckle, and the upper receiver pivots upward to said semi-secure upper receiver position. Said radial width of the flange may be 35% to 45% of the proximal portion diameter and of the distal portion diameter, for example. The midsection may further comprise a lip that protrudes from the first flange surface, the lip being transverse to the first flange surface and the lip being adapted to abut against a portion of the rear knuckle adjacent to the slot, when the pin is in the semi-secure position to prevent the takedown pin from entirely sliding out of the rear knuckle. The proximal end portion of the takedown pin may comprise a first circumferential detent track portion having a plurality of detent dimples, for cooperation with a detent pin system of the lower receiver when the takedown pin rotates. The distal end portion of the takedown pin may comprise a second circumferential detent track portion having a plurality of detent dimples. In certain embodiments having the circumferential track portion(s), the takedown pin is rotatable to place the lower and upper receivers in all of a unsecure condition, secure condition, and said semi-secure condition, without moving the takedown pin axially.

In the Summary of the Invention above, throughout the Detailed Description, and in the accompanying drawings, reference is made to particular features, including method steps, of certain embodiments of the invention. It is to be understood that the disclosure of the invention in this specification includes all possible and effective combinations of such particular features. For example, where a particular feature is disclosed in the context of a particular aspect, a particular embodiment, or a particular Figure, that feature can also be used, to the extent appropriate and effective, in the context of other particular aspects, embodiments, and Figures, and in the invention generally.

It is understood that further modifications and alternative embodiments of various aspects of the inventions may be apparent to those skilled in the field. Thus, it is also understood that certain embodiments of the takedown pin and upper receiver could be materialized from a variety of elements, and certain embodiments may have alternative shapes and dimensions to those portrayed. Further, in certain embodiments, the features of the takedown pin and upper receiver, and the methods of using them, may be utilized and configured independently outside of the realm, and outside of the firearm components, illustrated and described herein. Although this disclosed technology has been described above with reference to particular means, materials, and embodiments, it is to be understood that the disclosed technology is not limited to these disclosed particulars, but extends instead to all equivalents within the scope of the following claims.

The invention claimed is:

1. A firearm takedown pin receiver-connection system comprising: a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together;

the system further comprising a takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position;

wherein the rear knuckle has a slot through a bottom portion of the rear knuckle, the slot having a slot width, and wherein said at least one axial side surface having a recess comprises a first flange surface in the midsection on a first axial side of the midsection, and a second flange surface in the midsection on an opposing second axial side of the midsection, wherein the first and second flange surfaces are parallel to each other and form a flange having a radial width that is said maximum radial width and that is smaller than the slot width, so that when the takedown pin is rotated to said semi-secure pin position, the rear knuckle slides upward relative to the takedown pin midsection so that the flange is received in the slot and the upper receiver pivots upward to said semi-secure upper receiver position.

2. The system of claim 1, wherein said radial width of the flange is 35-45% of the proximal portion diameter and of the distal portion diameter.

3. The system of claim 2, wherein a first slot edge and a second slot edge of the bottom portion of the rear knuckle define said slot, and the midsection further comprises a lip that protrudes from the first flange surface, the lip being transverse to the first flange surface and the lip being adapted to abut against said first slot edge when the pin is in the semi-secure position to prevent the takedown pin from entirely sliding out of the rear knuckle.

4. The system of claim 1, wherein the lower receiver further comprises a detent pin system, and the proximal end portion of the takedown pin comprises a first circumferential detent track portion having a plurality of detent dimples, so that the detent pin system cooperates with the circumferential detent track portion and said detent dimples during rotation of the takedown pin.

5. The system of claim 4, wherein the distal end portion of the takedown pin comprises a second circumferential detent track portion having a plurality of detent dimples.

6. A firearm takedown pin receiver-connection system comprising: a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together;

the system further comprising a takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position;

wherein the lower receiver further comprises a detent pin system, and the proximal end portion of the takedown pin comprises a first circumferential detent track portion having a plurality of detent dimples, so that the detent pin system cooperates with the circumferential detent track portion and said detent dimples during rotation of the takedown pin; and the takedown pin is rotatable to place the lower and upper receivers in all of an unsecure condition, a secure condition, and a semi-secure condition that comprises the upper receiver being in said semi-secure upper receiver position, without moving the takedown pin axially.

7. The system of claim 6, wherein the distal end portion of the takedown pin comprises a second circumferential detent track portion having a plurality of detent dimples.

8. A firearm takedown pin for connection of a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together, the rear knuckle having a slot through a bottom portion of the rear knuckle and the slot having a slot width;

the takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position;

wherein said at least one axial side surface having a recess comprises a first flange surface in the midsection on a first axial side of the midsection, and a second flange surface in the midsection on an opposing second axial side of the midsection, wherein the first and second flange surfaces are parallel to each other and form a flange having a radial width that is said maximum radial width and that is smaller than the slot width, so that when the takedown pin is rotated to said semi-secure pin position, the rear knuckle slides upward relative to the takedown pin midsection so that the flange is received in the slot, and the upper receiver pivots upward to said semi-secure upper receiver position.

9. The pin of claim 8, wherein said radial width of the flange is 35 to 45 percent of the proximal portion diameter and of the distal portion diameter.

10. The pin of claim 9, wherein the midsection further comprises a lip that protrudes from the first flange surface, the lip being transverse to the first flange surface and the lip being adapted to abut against a portion of the rear knuckle adjacent to the slot, when the pin is in the semi-secure position to prevent the takedown pin from entirely sliding out of the rear knuckle.

11. The pin of claim 8, wherein the proximal end portion of the takedown pin comprises a first circumferential detent track portion having a plurality of detent dimples, for cooperation with a detent pin system of the lower receiver when the takedown pin rotates.

12. The pin of claim 11, wherein the distal end portion of the takedown pin comprises a second circumferential detent track portion having a plurality of detent dimples.

13. A firearm takedown pin for connection of a firearm lower receiver having a rear coupler comprising a proximal sidewall with a proximal pin hole and a distal sidewall with distal pin hole, and a firearm upper receiver having a rear knuckle with a takedown pin hole defined by an inner hole surface, wherein front ends of the lower receiver and upper receiver are pivotally connected together;

the takedown pin comprising a main body with a proximal end portion with a proximal end portion diameter, a distal end portion with a distal end portion diameter, a longitudinal axis between the proximal and distal end portions and a radial dimension transverse to the longitudinal axis, and a midsection located between said proximal and distal end portions, wherein the midsection comprises at least one axial side surface having a recess so that the midsection has a maximum radial width that is smaller than the proximal end portion diameter and smaller than the distal end portion diameter, wherein said proximal end portion and said distal end portion are adapted to be received in the proximal and distal pin holes, respectively, and the midsection is adapted to be received and rotatable in the takedown pin hole of the rear knuckle, so that when the pin is rotated in the takedown pin hole to a semi-secure pin position, the rear knuckle slides upward relative to the takedown pin midsection so that the upper receiver is pivotal upward to a semi-secure upper receiver position;

wherein the proximal end portion of the takedown pin comprises a first circumferential detent track portion having a plurality of detent dimples, for cooperation with a detent pin system of the lower receiver when the takedown pin rotates;

wherein the takedown pin is rotatable to place the lower and upper receivers in all of an unsecure condition, a secure condition, and-a semi-secure condition that comprises the upper receiver being in said semi-secure upper receiver position, without moving the takedown pin axially.

14. The pin of claim 13, wherein the distal end portion of the takedown pin comprises a second circumferential detent track portion having a plurality of detent dimples.

* * * * *